US010337514B2

(12) United States Patent
Mahure et al.

(10) Patent No.: US 10,337,514 B2
(45) Date of Patent: Jul. 2, 2019

(54) SCROLL COMPRESSOR HAVING AN INSULATED HIGH-STRENGTH PARTITION ASSEMBLY

(71) Applicant: Emerson Climate Technologies, Inc., Sidney, OH (US)

(72) Inventors: Yogesh S. Mahure, Pune (IN); Pavankumar Pralhad Jorwekar, Ahmednagar (IN); Pankaj Ahire, Pune (IN); Rohan R. Prabhu, Pune (IN)

(73) Assignee: Emerson Climate Technologies, Inc., Sidney, OH (US)

( * ) Notice: Subject to any disclaimer, the term of this patent is extended or adjusted under 35 U.S.C. 154(b) by 183 days.

(21) Appl. No.: 15/095,886

(22) Filed: Apr. 11, 2016

(65) Prior Publication Data

US 2016/0305430 A1 Oct. 20, 2016

(30) Foreign Application Priority Data

Apr. 17, 2015 (IN) ..... 1584MUM2015

(51) Int. Cl.
*F04C 29/04* (2006.01)
*F04C 18/02* (2006.01)
(Continued)

(52) U.S. Cl.
CPC ..... *F04C 29/04* (2013.01); *F01C 21/10* (2013.01); *F04C 18/0215* (2013.01);
(Continued)

(58) Field of Classification Search
CPC .... F01C 21/10; F04C 18/0215; F04C 23/008; F04C 29/04; F04C 29/065; F04C 29/068; F04C 2230/231; F05C 2251/048
(Continued)

(56) References Cited

U.S. PATENT DOCUMENTS 2,939,811 A * 6/1960 Dillon ..... E04B 1/80 220/592.05
4,449,610 A 5/1984 Bar
(Continued)

FOREIGN PATENT DOCUMENTS

CN 1106505 A 8/1995
CN 1644927 A 7/2005
(Continued)

OTHER PUBLICATIONS

Office Action regarding Chinese Patent Application No. 201620328617.0, dated Aug. 9, 2016. Translation provided by Unitalen Attorneys at Law.

(Continued)

*Primary Examiner* — Mary Davis
*Assistant Examiner* — Dapinder Singh
(74) *Attorney, Agent, or Firm* — Harness, Dickey & Pierce, P.L.C.

(57) ABSTRACT

The present disclosure provides a high-strength thermally insulative partition assembly (e.g., muffler plate) for use in a scroll compressor. The assembly includes at least one metal plate and an insulating region. The insulating region may have at least one insulating material or may be a low-pressure or vacuum chamber. The partition assembly serves to minimize heat transfer between a low-pressure refrigerant on the low-pressure, suction side and a high-pressure, high-temperature refrigerant on the high-pressure, discharge side of the compressor. The insulating region may be sandwiched between multiple metal plates. The insulating region may be coated on the metal plate. The insulating region may also be a preformed component or mask that is coupled to the metal plate via a mechanical interlock system.

19 Claims, 10 Drawing Sheets

(51) Int. Cl.
*F01C 21/10* (2006.01)
*F04C 23/00* (2006.01)
*F04C 29/06* (2006.01)

(52) U.S. Cl.
CPC ..... *F04C 23/008* (2013.01); *F04C 29/065* (2013.01); *F04C 29/068* (2013.01); *F04C 2230/231* (2013.01); *F05C 2251/048* (2013.01)

(58) Field of Classification Search
USPC ..... 418/179
See application file for complete search history.

(56) References Cited

U.S. PATENT DOCUMENTS

| | | | | |
|---|---|---|---|---|
| 4,477,229 | A | 10/1984 | Kropiwnicki et al. | |
| 4,784,583 | A | 11/1988 | Bar | |
| 5,622,487 | A | 4/1997 | Fukuhara et al. | |
| 5,735,678 | A * | 4/1998 | Fukuhara | F04C 23/008 418/270 |
| 5,749,714 | A | 5/1998 | Lee | |
| 6,287,089 | B1 | 9/2001 | Williams et al. | |
| 6,428,293 | B1 | 8/2002 | Dewar et al. | |
| 6,461,130 | B1 | 10/2002 | Sun et al. | |
| 6,461,132 | B1 | 10/2002 | Sun et al. | |
| 6,547,543 | B2 | 4/2003 | Sun et al. | |
| 6,592,344 | B2 | 7/2003 | Witham et al. | |
| 9,004,879 | B2 | 4/2015 | Yang et al. | |
| 9,121,276 | B2 | 9/2015 | Heidecker et al. | |
| 9,587,634 | B2 | 3/2017 | Cho | |
| 9,605,677 | B2 | 3/2017 | Heidecker et al. | |
| 2014/0024563 | A1 | 1/2014 | Heidecker et al. | |

FOREIGN PATENT DOCUMENTS

| | | | |
|---|---|---|---|
| CN | 106401974 | A | 2/2017 |
| CN | 206054310 | U | 3/2017 |
| EP | 1555437 | A1 | 7/2005 |
| JP | H8177763 | A | 7/1996 |
| JP | 2005240562 | A | 9/2005 |
| KR | 19990060803 | A | 7/1999 |
| WO | 2014/018530 | A1 | 1/2014 |

OTHER PUBLICATIONS

Emerson Climate Technologies, Inc. Annual Energy Efficiency Ratio: A Better Measure of Refigeration System Performance. Oct. 2007. pp. 1-21.

Office Action regarding Chinese Patent Application No. 201610243323.2, dated Jan. 3, 2018. Translation provided by Unitalen Attorneys at Law.

* cited by examiner

SCROLL COMPRESSOR HAVING AN INSULATED HIGH-STRENGTH PARTITION ASSEMBLY

CROSS-REFERENCE TO RELATED APPLICATIONS

This application claims the benefit of Indian Patent Application No. 1584MUM2015, filed on Apr. 17, 2015. The entire disclosure of the application referenced above is incorporated herein by reference.

FIELD

The present disclosure relates to an improved high-strength thermally insulating partition or muffler plate assembly for use in scroll compressors.

BACKGROUND

This section provides background information related to the present disclosure which is not necessarily prior art.

Scroll compressors have a housing that contains a scroll compression mechanism with two intermeshed scroll components, a motor for driving the scroll compression mechanism, an intake for receiving refrigerant to be compressed, and a discharge from the housing for expelling pressurized, processed refrigerant. Certain scroll compressor designs may be hermetically or semi-hermetically sealed with a high-side pressure design that includes both a high-side pressure region and a low-side pressure region inside the housing. A high-pressure region or high-side corresponds to areas of the scroll compressor exposed to high pressure and temperature conditions corresponding to discharge gas conditions (e.g., after refrigerant is processed in the scroll compression mechanism). A low-pressure region or low-side corresponds to areas of the scroll compressor having lower pressures prior to the refrigerant being fully processed in the scroll compression mechanism.

In hermetically or semi-hermetically sealed motor compressors, the refrigerant gas, which enters the housing as vapor at the inlet on the low-side, passes into and is processed within the compression mechanism, where it forms a compressed, pressurized refrigerant gas that passes through the high-side discharge. In such scroll compressors, a muffler plate or separator partition plate isolates the high-pressure side (discharge refrigerant that is at high temperatures and high pressures) from the low-pressure side (inlet or suction refrigerant that is at low temperatures and low pressures). When compressing the refrigerant (e.g., gas), work is required, thus generating heat. The processed discharge gas thus has significantly higher temperatures and pressures than the pre-processed suction refrigerant.

The heat may undesirably be transmitted from the high-pressure discharge gas to the low-pressure side, thus increasing suction gas temperatures and undesirably reducing the suction gas density. By heating the refrigerant gas on the low-pressure suction or inlet side, the refrigerant gas increases its volume, thus a mass flow rate of refrigerant gas entering the compression mechanism is lower than a mass flow rate of gas that would otherwise enter the compression mechanism if the refrigerant gas was at a lower temperature. This refrigerant heating thus causes a smaller amount of inlet refrigerant gas to be introduced into the compression mechanism, causing a loss of efficiency of the refrigerant cycle. Accordingly, increasing refrigerant gas temperature and thus reducing its density adversely affects the compressor cooling capacity and power consumption. If heat transfer from a high-pressure discharge side to the low-pressure suction/inlet side is reduced, this can improve compressor performance and discharge line temperatures. It would be desirable to have improved high-strength, robust partition or muffler plates that advantageously reduce heat transfer from a high-pressure side to a low-pressure side to improve compressor performance and efficiency.

SUMMARY

This section provides a general summary of the disclosure and is not a comprehensive disclosure of its full scope or all of its features.

The present disclosure provides a high-strength thermally insulative partition assembly for a scroll compressor. In certain variations, the high-strength thermally insulative partition assembly comprises a metal plate and an insulating region integral with the metal plate. In certain aspects, the insulating region has a thermal conductivity (K) of less than or equal to about 300 mW/m·K at standard temperature and pressure conditions. In certain other aspects, the high-strength thermally insulative partition assembly has a tensile strength of greater than or equal to about 35,000 psi (about 241 MPa).

The high-strength thermally insulative partition assembly may optionally have a thermal conductivity that is greater than or equal to about 0.5 mW/m·K and less than or equal to about 60 mW/m·K.

In certain aspects, the metal plate of the high-strength thermally insulative partition assembly may optionally be a first metal plate, while the assembly further comprises a second metal plate. The insulating region may be sandwiched between the first metal plate and the second metal plate. In certain aspects, the insulating region comprises an insulating material. In certain other aspects, the insulating material may be selected from the group consisting of: polymers, polymeric composites, foam, opacified powder, evacuated powder, and combinations thereof. In yet other aspects, the insulating material is optionally selected from the group consisting of: polytetrafluoroethylene (PTFE), polyurethane, polyamides, nylon, rubbers, elastomers, silica, glass, gas-filled powders, gas-filled fibers, aerogels, perlite, vermiculite, rock wool, lampblack, evacuated calcium silicate, opacified powder, evacuated powder, and combinations thereof.

In certain other aspects, the insulating region is a low-pressure chamber or a vacuum chamber.

In yet other aspects, the high-strength thermally insulative partition assembly comprises the insulating region that is formed as an insulating coating on a surface of the metal plate. The insulating coating may be absent (e.g., removed) on edge regions of the metal plate that correspond to weld zones.

In other aspects, the insulating region of the high-strength thermally insulative partition assembly is a distinct mask component that is secured to the metal plate via a mechanical interlock or a mold-in feature. The mask component may optionally define a first discharge portion. The metal plate may define a second discharge portion. The first discharge portion of the mask component defines a seat and comprises a plurality of tabs that radially compress in a first position for sliding engagement with a second discharge portion on the metal plate. The second discharge portion is secured within the seat of the first discharge portion after expansion of the plurality of tabs to a second position.

In other aspects, the mask can be a mold-in feature or an insert molded feature that may not be a separate attachment.

In other aspects, the mask component optionally comprises a plurality of protrusions on a first engagement surface and the metal plate comprises a plurality of undercuts on a second engagement surface. The plurality of protrusions and the plurality of undercuts that are complementary to one another thus define the mechanical interlock. The plurality of protrusions secures the metal plate to the mask component when the first engagement surface and the second engagement surface are slid or otherwise brought into contact with one another.

In certain other variations, the present disclosure provides a scroll compressor. The scroll compressor has a first scroll member having a discharge port and a first spiral wrap. The scroll compressor also has a second scroll member having a second spiral wrap. The first and second spiral wraps are mutually intermeshed to define a peripheral suction zone in fluid communication with an inlet that receives low-pressure refrigerant. The scroll compressor also comprises a high-strength thermally insulative partition assembly comprising a metal plate and an insulating region that is disposed between the first scroll member and a discharge chamber in fluid communication with the discharge port. The insulating region may have a thermal conductivity (K) of less than or equal to about 300 mW/m·K at standard temperature and pressure conditions. In certain aspects, the high-strength thermally insulative partition assembly has a tensile strength of greater than or equal to about 35,000 psi (about 241 MPa). The scroll compressor further includes a motor for causing the second scroll member to orbit with respect to the first scroll member. In this manner, the first spiral wrap and the second spiral wrap create at least one enclosed space of progressively changing volume between the peripheral suction zone and the discharge port to create a high-pressure refrigerant. The high-strength thermally insulative partition assembly minimizes or prevents heat transfer between the high-pressure refrigerant in the discharge chamber and the low-pressure refrigerant in the peripheral suction zone.

In certain aspects, the high-strength thermally insulative partition assembly minimizes or prevents heat transfer between the high-pressure refrigerant in the discharge chamber and the low-pressure refrigerant in the peripheral suction zone so that a temperature of the low-pressure refrigerant rises less than or equal to about 30% between the inlet and entering the peripheral suction zone due to the heat transfer. In other aspects, the insulating region of the high-strength thermally insulative partition assembly has a thermal conductivity (K) of less than or equal to about 300 mW/m·K at standard temperature and pressure conditions. The high-strength thermally insulative partition assembly optionally has a tensile strength of greater than or equal to about 35,000 psi (about 241 MPa).

The metal plate of the high-strength thermally insulative partition assembly may optionally be a first metal plate, while the assembly further comprises a second metal plate. The insulating region may optionally be sandwiched between the first metal plate and the second metal plate. In certain aspects, the insulating region is optionally a low-pressure chamber or a vacuum chamber, or comprises an insulating material.

In certain aspects, the insulating region comprises an insulating material. In certain other aspects, the insulating material may be selected from the group consisting of: polymers, polymeric composites, foam, and combinations thereof. In yet other aspects, the insulating material is optionally selected from the group consisting of: polytetrafluoroethylene (PTFE), polyurethane, polyamides, nylon, rubbers, elastomers, silica, glass, gas-filled powders, gas-filled fibers, aerogels, perlite, vermiculite, rock wool, lampblack, evacuated calcium silicate, and combinations thereof.

In certain other aspects, the insulating region is a low-pressure chamber or a vacuum chamber.

In yet other aspects, the high-strength thermally insulative partition assembly comprises the insulating region that is formed as an insulating coating on a surface of the metal plate. The insulating coating may be absent (e.g., removed) on edge regions of the metal plate that correspond to weld zones.

In other aspects, the first metal plate and the second metal plate are joined to each other and a portion of a housing of the scroll compressor at a peripheral region by a fillet weld joint, a lap weld joint, a butt weld joint, an insert weld joint, or a resistance weld nugget.

In yet another variation, a method of operating a scroll compressor is provided. The method may comprise introducing a low-pressure refrigerant into a peripheral suction zone of a compression mechanism comprising a first scroll member having a discharge port and a first spiral wrap and a second scroll member having a second spiral wrap. The first and second spiral wraps are mutually intermeshed to create at least one enclosed space of progressively changing volume for compression between the peripheral suction zone and the discharge port to create a high-pressure refrigerant. The method further includes compressing the low-pressure refrigerant in the compression mechanism by orbiting the second scroll member with respect to the first scroll member to create a high-pressure refrigerant that exits through the discharge port of the first scroll member into a discharge chamber. A high-strength thermally insulative partition assembly is disposed between the first scroll member and the discharge chamber. The high-strength thermally insulative partition assembly comprises a metal plate and an insulating region having a thermal conductivity (K) of less than or equal to about 300 mW/m·K at standard temperature and pressure conditions. The high-strength thermally insulative partition assembly has a tensile strength of greater than or equal to about 35,000 psi (about 241 MPa).

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 11:
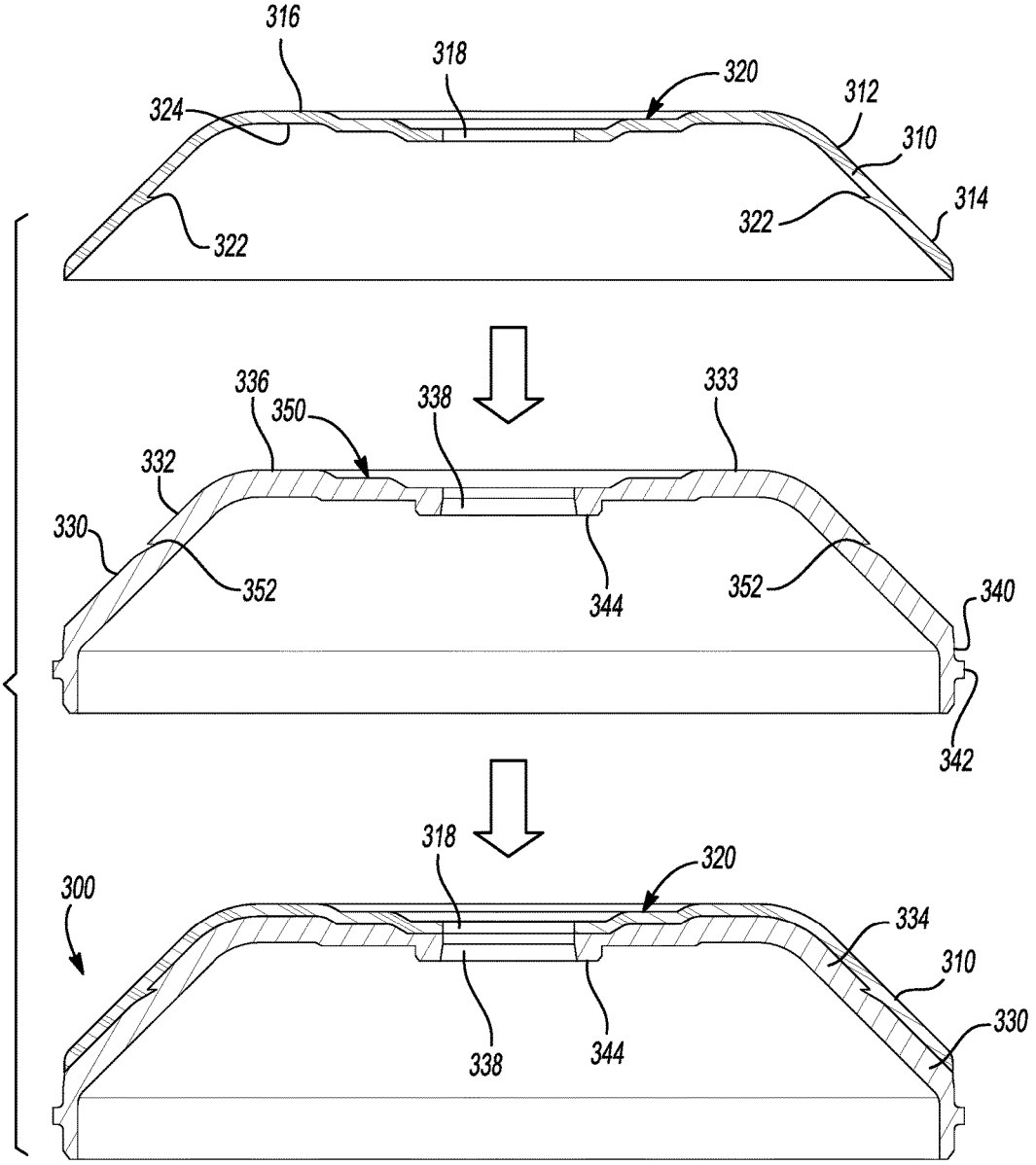

FIG. 11 is an exploded view of various components of a high-strength thermally insulative partition assembly, including a metal plate structure and a pre-formed insulating component mask that is attached to the metal plate structure via another distinct mechanical interlock according to certain other variations of the present disclosure. In certain other variations, the insulating component mask may be a mold-in feature or formed via insert molding as a single piece.

Figure 12:
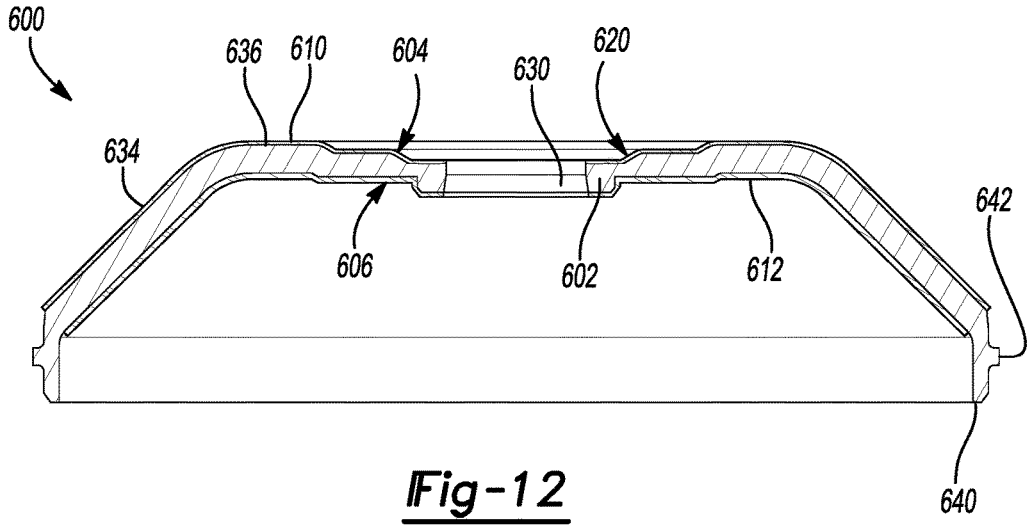

FIG. 12 shows a high-strength thermally insulative partition assembly, including a metal plate structure and two insulating regions formed as coatings on an upper surface and a lower surface of the metal plate structure according to certain other variations of the present disclosure.

Figure 3:
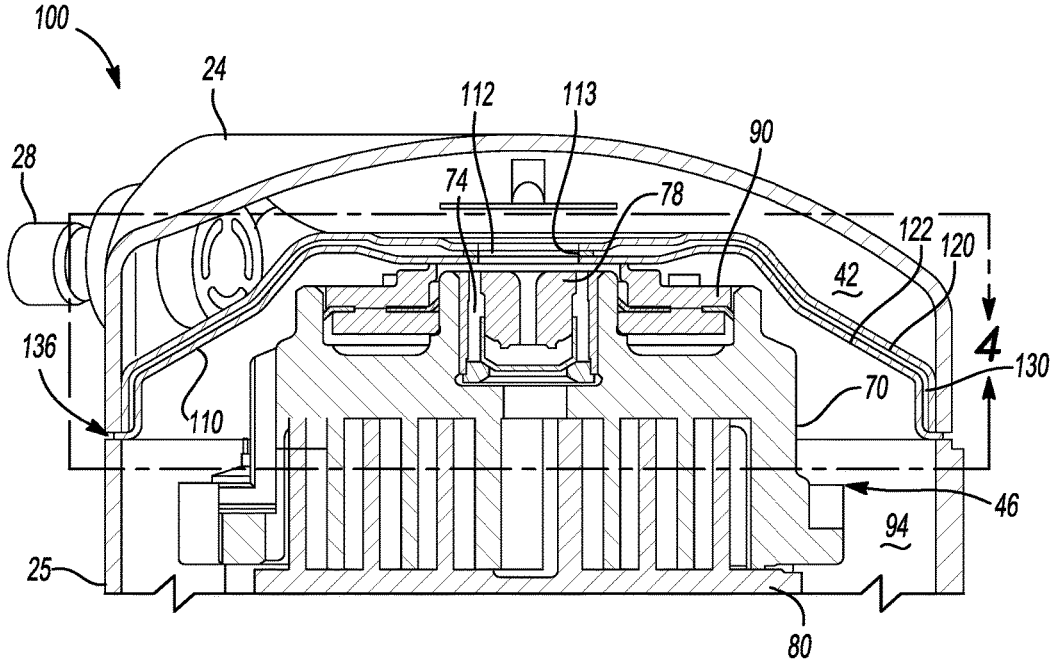
FIG. 3 is a sectional partial view of an upper portion of a scroll compressor having a muffler plate that is a high-strength thermally insulative partition assembly comprising a metal structure having at least one insulating region according to certain variations of the present disclosure.
Figure 4:
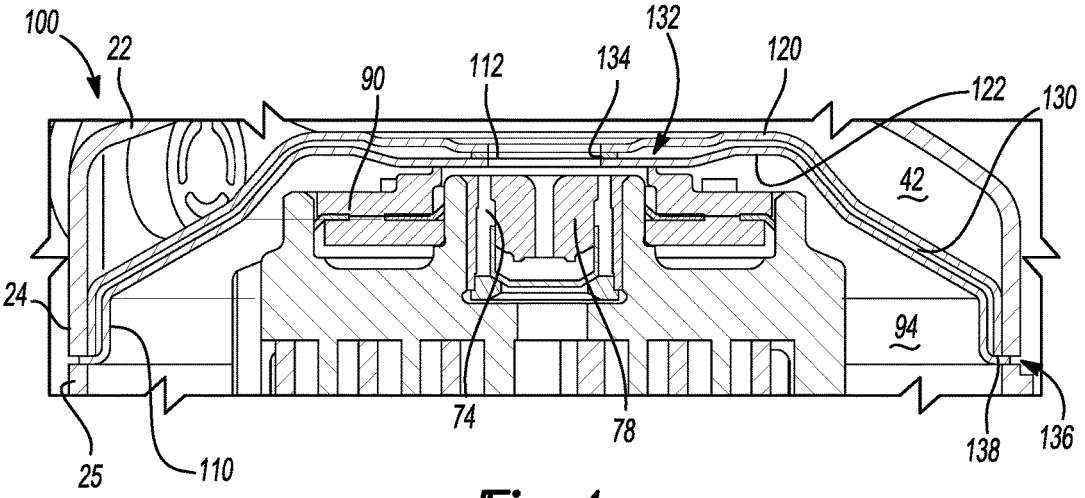
FIG. 4 is a detailed view taken along line 4-4 of FIG. 3.
Figure 13:
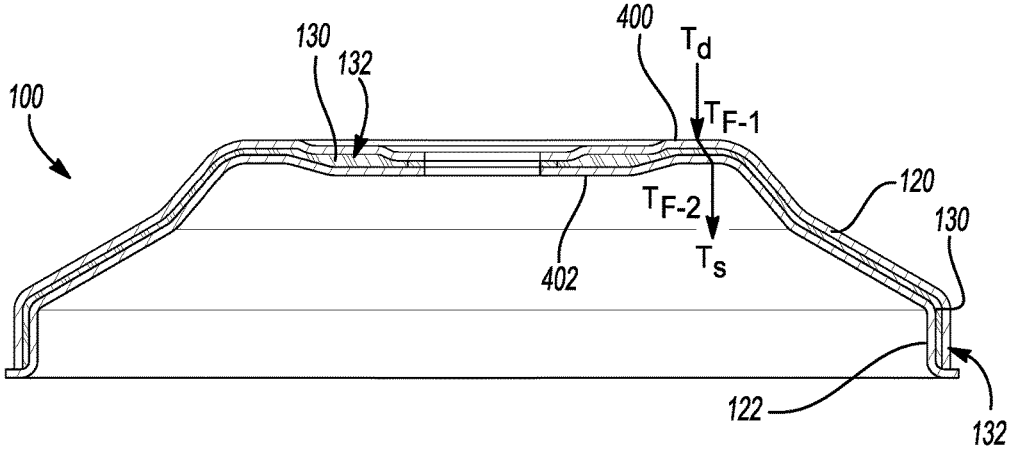

FIG. 13 shows a schematic of a heat transfer mechanism across a high-strength thermally insulative partition assembly according to certain embodiments of the present disclosure shown in FIGS. 3-4.

Figure 10:
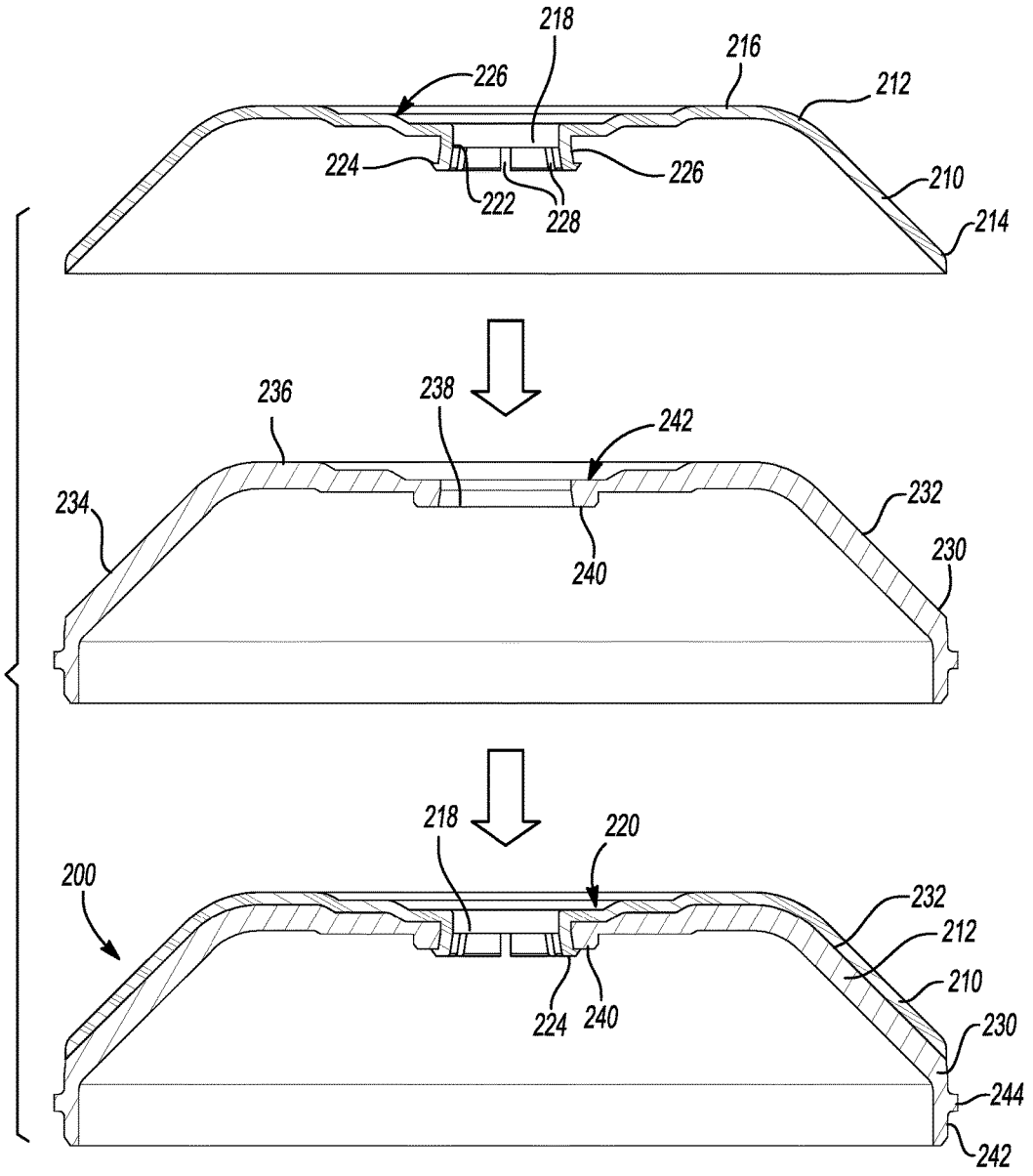
FIG. 10 is an exploded view of various components of a high-strength thermally insulative partition assembly, including a metal plate structure and a pre-formed insulating component mask that is attached to the metal plate structure via a mechanical interlock according to certain variations of the present disclosure.
Figure 14:
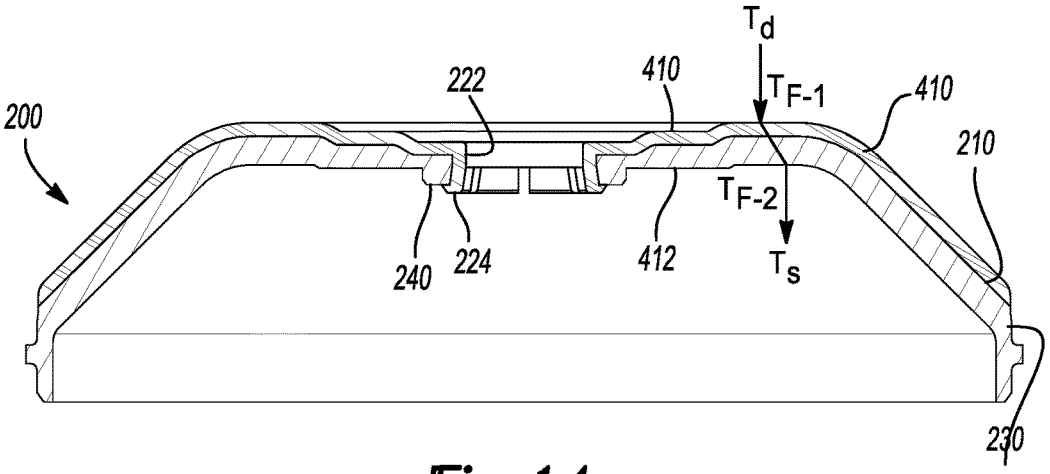

FIG. 14 shows a schematic of a heat transfer mechanism across a high-strength thermally insulative partition assembly according to certain embodiments of the present disclosure shown in FIG. 10.

Figure 15:
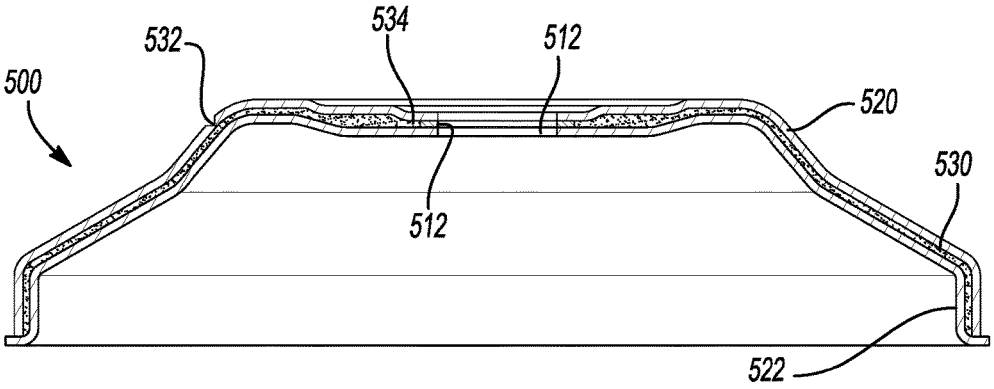

FIG. 15 shows another variation of a high-strength thermally insulative partition assembly comprising a metal structure sandwiching an insulating low-pressure or vacuum chamber according to certain variations of the present disclosure.

Figure 16:
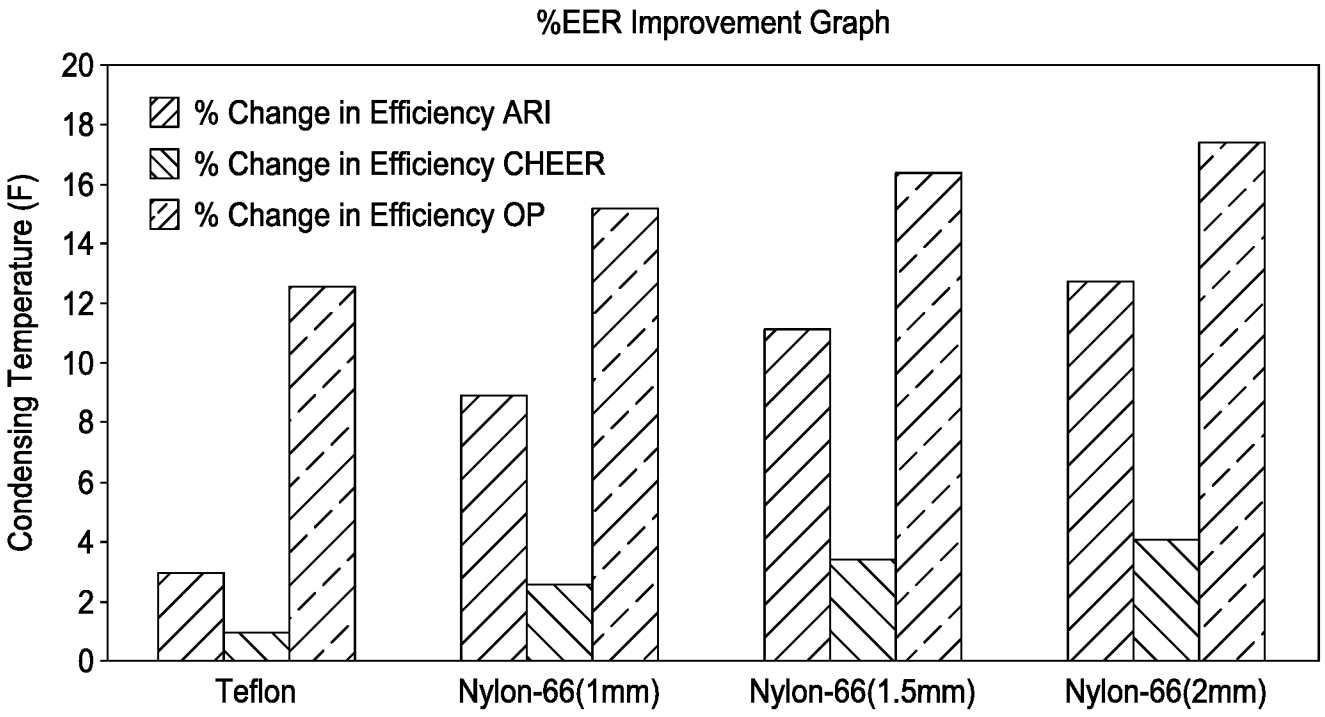

FIG. 16 is a graph showing energy efficiency ratio (EER) scroll compressor performance improvement for various embodiments of muffler partition plates prepared according to the present disclosure having different insulating materials (a TEFLON™ PTFE sandwiched insulating region and insulating masks formed of nylon-66 at different thicknesses (1 mm, 1.5 mm, and 2 mm, respectively)).

Figure 17:
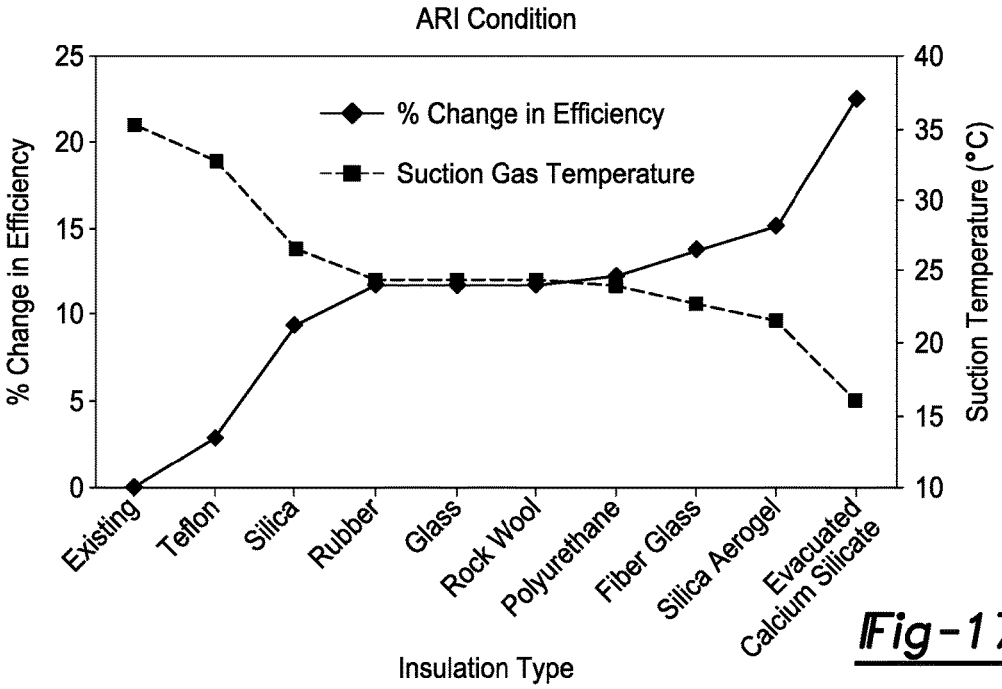

FIG. 17 is a model calculating % change in efficiency for scroll compressors operating at Air Conditioning and Refrigerating (ARI) standard operating conditions of (45°/130°/65° F.), including a comparative scroll compressor incorporating a conventional muffler plate compared with scroll compressor incorporating muffler plates according to various embodiments of the present disclosure having different insulating materials.

Figure 18:
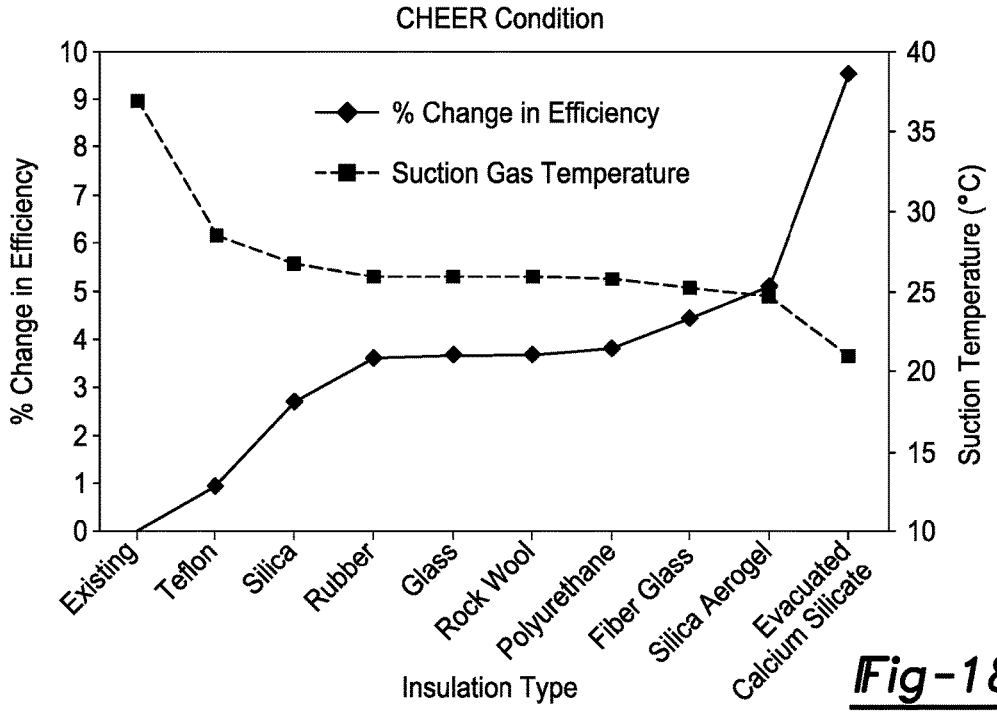

FIG. 18 is a model calculating % change in efficiency for scroll compressors operating at CHEER standard operating conditions (45°/100°/65° F.), including a comparative scroll compressor incorporating a conventional muffler plate compared with scroll compressor incorporating muffler plates according to various embodiments of the present disclosure having different insulating materials.

Figure 19:
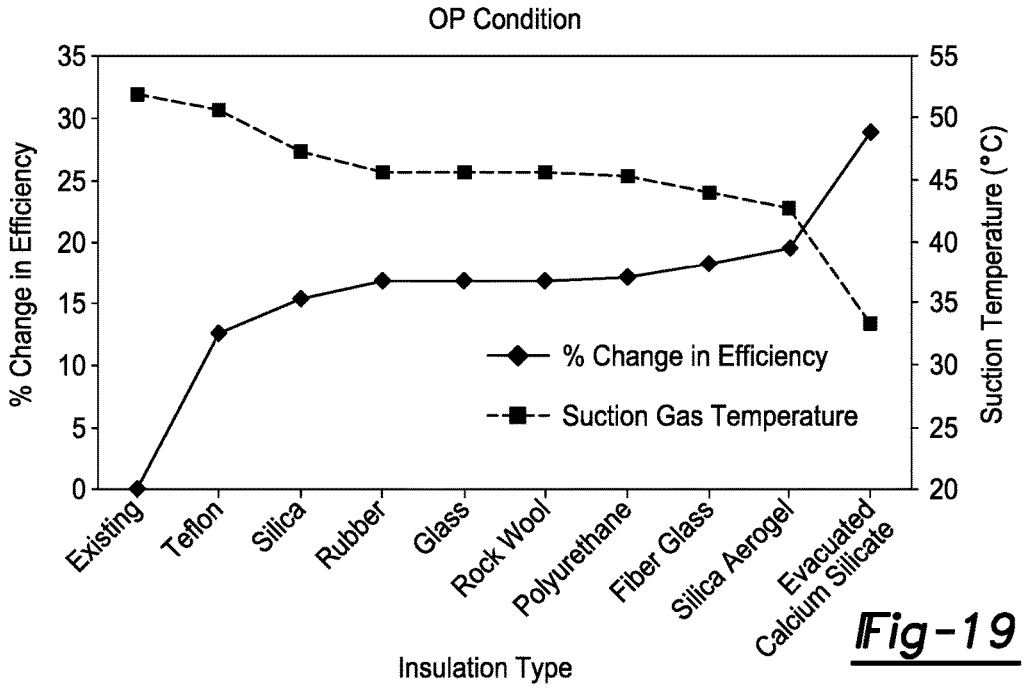

FIG. 19 is a model calculating % change in efficiency for scroll compressors at normal operating conditions, including a comparative scroll compressor incorporating a conventional muffler plate compared with scroll compressor incorporating muffler plates according to various embodiments of the present disclosure having different insulating materials.

Figure 20:
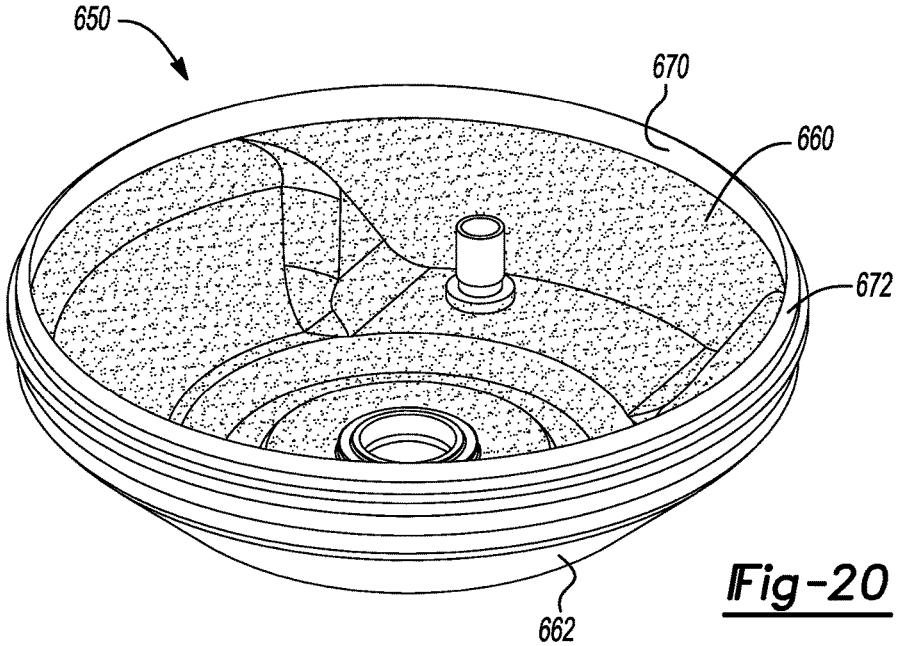

FIG. 20 shows a high-strength thermally insulative muffler partition assembly according to certain other variations of the present disclosure that includes a metal plate structure and two insulating regions formed as coatings on an upper surface and a lower surface of the metal plate structure, where the lower surface insulating coating has been removed in edge regions of the metal plate structure prior to welding that will correspond to weld zones of the metal plate.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters.

In addition, disclosure of ranges includes disclosure of all values and further divided ranges within the entire range, including endpoints and sub-ranges given for the ranges.

Figure 1:
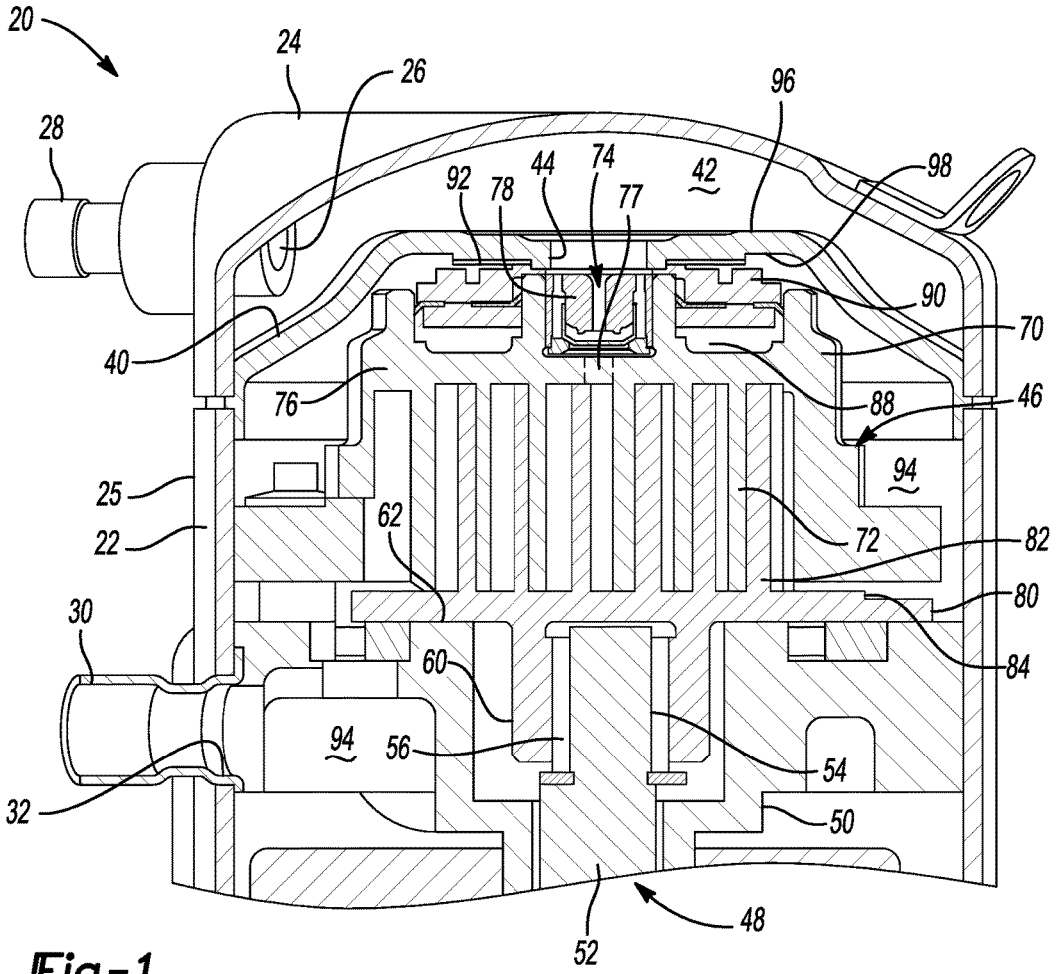
FIG. 1 is a sectional partial view through a center of an upper portion of a scroll compressor.

In various aspects, the present disclosure pertains to compressors, such as scroll compressors, that incorporate improved high-strength, robust separator or muffler plate assemblies to advantageously reduce heat transfer from a high-pressure side to a low-pressure side and thus improve compressor efficiency. An exemplary scroll compressor 20 is shown in FIG. 1. The scroll compressor 20 includes a generally cylindrical hermetic housing or shell 22. Shell 22 includes a cap 24 and a lower shell portion 25 that are welded together. Cap 24 is provided with a refrigerant discharge fitting 28 at opening 26 that may have the usual discharge valve therein. An inlet fitting 30 is disposed over opening 32 at a middle region of shell 22.

Other major elements affixed to the shell 22 include a transversely extending partition 40 that is welded about its periphery at the same point that cap 24 is welded to lower shell portion 25 of shell 22. A discharge chamber 42 is thus defined by cap 24 and partition 40. The transversely extending partition 40 and discharge chamber 42 may generally form a discharge muffler for compressor 20.

A compression mechanism 46 may be driven by motor assembly 48 and may be supported by main bearing housing 50. The compression mechanism 46 may include a first non-orbiting scroll member 70 and a second orbiting scroll member 80. Non-orbiting scroll member 70 has a spiral scroll vane or wrap 72 attached thereto that is positioned in meshing engagement with a spiral scroll vane or wrap 82 of orbiting scroll 80. Spiral scroll vane 82 extends from a base plate portion 84. Non-orbiting scroll 70 has a centrally disposed discharge passage 74 defined by a base plate portion 76. Non-orbiting scroll 70 also includes an annular hub portion 77 which surrounds the discharge passage 74. An annular recess 88 is also formed in non-orbiting scroll 70 within which is disposed a floating seal assembly 90. The floating seal assembly 90 is thus supported by the non-orbiting scroll 70 and engages a seat portion 92 mounted to or forming part of the partition 40 for sealingly dividing an intake chamber 94 from the discharge chamber 42.

The orbiting scroll 80 of the compression mechanism 46 is driven by an electric motor assembly 48. A crank shaft 52 having an eccentric crank pin 54 at the upper end thereof is rotatably journaled in a drive bushing/upper bearing assembly 56 disposed in a cylindrical hub 60 of an orbiting scroll 80. Crank shaft 52 rotating drives orbiting scroll 70. Crank shaft 52 is thus rotatably driven by electric motor assembly 48 press fitted on a lower portion of crank shaft 52 (not shown).

Main bearing housing 50 may be secured to shell 22. The upper surface of the main bearing housing 50 is provided with a flat thrust bearing surface 62 on which is disposed an orbiting scroll 80. As noted above, the spiral vane 82 of orbiting scroll 80 is positioned in meshing engagement with spiral vane 72 of non-orbiting scroll 70.

The intake chamber 94 is in fluid communication with compressor inlet fitting 30 disposed over the inlet opening 32 through which the fluids (e.g., refrigerant) to be compressed are drawn into pockets defined between the intermeshed spiral vanes 72, 82. After the fluid is processed and compressed in the spiral vanes 72, 82, it is then released through the discharge passage 74. Partition 40 includes an opening 44, through which compressed fluid (exiting the non-orbiting scroll 70) can pass as it enters the discharge chamber 42. A reed valve assembly 78 or other known valve assembly may be provided in the discharge passage 74 to regulate flow from the discharge passage 74 through opening 44 and into discharge chamber 42 (e.g., the discharge muffler chamber) that is in fluid communication with opening 26 and refrigerant discharge fitting 28.

The floating seal assembly 90 is supported by the annular recess 88 of non-orbiting scroll 70 and engages a seat portion 92 mounted to or on the partition 40 for sealingly dividing intake chamber 94 from discharge chamber 42. Recess 88 and floating seal assembly 90 cooperate to define an axial pressure biasing chamber which receives pressurized fluid being compressed by spiral vanes 72 and 82, so as to exert an axial biasing force on non-orbiting scroll 70 to thereby urge the tips of respective spiral vanes 72, 82 into sealing engagement with the opposed baseplate surfaces (base plate portion 76 of non-orbiting scroll 70 and base plate portion 84 of orbiting scroll 80). Thus intake chamber 94 and other regions having lower pressures (prior to compression of the fluid or refrigerant) correspond to a low-pressure side or low-side of the compressor 20. Discharge chamber 42 contains high-pressure, compressed fluid after processing in the compression mechanism 46, and thus is considered to be a high-pressure side or high-side.

As discussed above, in scroll compressors with high-side designs, the ability to isolate a high-pressure side having conditions corresponding to discharge refrigerant that is at high temperatures (e.g., discharge line temperatures) and high pressures from a low-pressure side having conditions corresponding to suction or refrigerant that is at low temperatures and low pressures, can improve compressor performance. Heat from discharge refrigerant fluid on the high-side can transfer to suction side or low-side, thus increasing suction fluid temperature. For example, a mass flow rate ($\dot{m}$) for refrigerant on the scroll compressor suction side can be expressed by: $\dot{m}=\eta_{vol}\omega V_{inlet}\rho_{suction}$. When temperature of refrigerant or fluid to be compressed is heated, it has a reduced density ($\rho_{suction}$), serving to reduce mass flow rate and detrimentally affect the compressor cooling capacity and power consumption. By reducing potential heat transfer from discharge or high-side to suction or low-side in accordance with the principles of the present disclosure, scroll compressor performance and discharge line temperatures can be improved.

More specifically, in certain conventional hermetically sealed scroll compressors, suction (input or inlet) and discharge (output) is divided by a separator partition or muffler plate. This partition is typically a single plate component formed of a metal material. Such a partition 40 is required to exhibit high strength levels, because it defines the divider between discharge chamber and suction pressure and thus must be physically robust and able to withstand large pressure and temperature differentials. When refrigerant enters into the suction or intake chamber 94, it is at very low temperatures and saturated pressure levels. After undergoing the compression process in the compression mechanism 46, the refrigerant enters into discharge chamber 42, which is enclosed and defined by the cap 24 and muffler plate/partition 40. That processed refrigerant is typically at very high pressures and temperatures. Due to the compression process (e.g., by being processed in compression mechanism 46), heat of compression is added to the refrigerant. Thus, the discharge chamber 42 has a high heat carrying zone as compared to the suction or intake chamber 94. This heat is directly dissipated towards the intake chamber 94 through partition 40 by heat of conduction and convection phenomena.

In other conventional hermetically sealed scroll compressor designs not illustrated here, the fixed scroll itself divides suction (input or inlet) and discharge (output) sides. Such designs seek to eliminate a separator partition or muffler plate and thus omit the thick separator/muffler plate altogether. In such a design, a thin shield may be used that is attached to the discharge side of the fixed scroll to prevent refrigerant in the discharge chamber from directly contacting the fixed scroll on the discharge side. Such shields are attached directly to the fixed scroll rather than the housing, for example, as a cap, thus the shields only experience high discharge pressure on one side (and a neutral region between the shield and the fixed scroll on the other side). These shield designs rely on the fixed scroll serving as the physical partition and barrier between discharge and suction sides, rather than a distinct partition separator plate coupled to the compressor housing that defines the discharge chamber. The shields are not exposed to extreme pressure differentials caused by contact with both high pressure discharge side and low pressure suction side; thus the shields do not require the high physical strength or large thicknesses required of a separator partition or muffler plate used in other designs.

Figure 2:
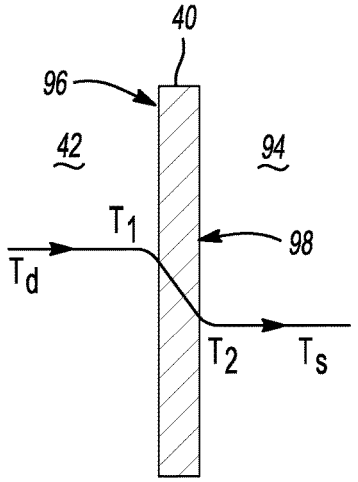
FIG. 2 shows a schematic of a heat transfer mechanism across a conventional muffler plate.

By way of further background, FIG. 2 shows a schematic of a heat transfer mechanism through a conventional muffler plate or partition 40 that has little or no thermal insulation. As shown $T_d$ is a discharge temperature within the discharge chamber 42. $T_s$ is a suction temperature corresponding to a temperature in the inlet chamber 94. $T_1$ is a refrigerant temperature along an upper surface (see upper surface 96 of partition 40 in FIG. 1) and $T_2$ is a refrigerant temperature along a lower surface (see lower surface 98 of partition 40 in FIG. 1). As can be seen, the greater the thermal conductivity of the partition 40, the greater the heat transfer via conduction and heat transfer, causing greater increases in $T_2$ and $T_s$ temperatures. This transferred heat raises the suction gas temperature $T_s$. Therefore suction gas is further superheated before entering into the compression mechanism 46. This effect causes an unnecessary increase in the compression power. Further, higher suction gas temperatures ($T_s$) give higher discharge line temperatures (DLTs). Higher DLTs require greater sizes for downstream condensers in the refrigeration system.

In accordance with various aspects of the present disclosure, a muffler plate or partition 40 is designed to minimize or prevent heat transfer from high-side to low-side in the compressor by having a low heat transfer coefficient. However, in the past, it has been a technical challenge to replace existing metallic muffler or partition plates with thermally non-conductive materials, such as plastics, because of the high strength functionally required for such a component. Thus, previous attempts to incorporate plastic separator or muffler plate have resulted in premature failure, because the material was incapable of exhibiting adequate long-term strength, while withstanding high temperatures, high pressures, and thermal cycling to which a separator or muffler plate is exposed.

In accordance with certain aspects of the present disclosure, a high-strength thermally insulative partition assembly for a scroll compressor is provided. The high-strength thermally insulative partition assembly comprises a metal structure and at least one insulating region. The high-strength thermally insulative partition assembly is used as a separator or partition, such as a muffler plate, which may be disposed between a first non-orbiting scroll member having a discharge port and a discharge chamber in fluid communication with the discharge port.

The high-strength thermally insulative partition assembly according to various aspects of the present disclosure minimizes or prevents heat transfer between the high-pressure refrigerant in the discharge chamber and the low-pressure refrigerant in the peripheral suction zone. In certain aspects, minimizing or preventing heat transfer is intended to mean that a temperature of a suction temperature ($T_s$) corresponding to an inlet chamber 94 temperature is raised less than or equal to about 30% due to heat transferred from the discharge chamber or high-side of the compressor (e.g., via conduction or convection heat transfer), optionally less than or equal to about 25%, optionally less than or equal to about 20%, optionally less than or equal to about 15%, optionally less than or equal to about 10%, optionally less than or equal to about 5%, optionally less than or equal to about 4%, optionally less than or equal to about 3%, optionally less than or equal to about 2%, and optionally less than or equal to about 1% due to heat transferred from the discharge chamber or high-side of the compressor.

By "high-strength," in certain variations, it is meant that the partition assembly exhibits a tensile strength of greater than or equal to about 35,000 psi (about 241 MPa), optionally greater than or equal to about 40,000 psi (about 276 MPa), and in certain aspects, optionally greater than or equal to about 45,000 psi (about 310 MPa).

By "thermally insulative," in certain variations, it is meant that a material used in the insulating region(s) of the partition assembly exhibits a thermal conductivity (K) at standard temperature and pressure conditions (about 32° F. or 0° C. and an absolute pressure of about 1 atm or 100 KPa) of less than or equal to about 0.5 W/m·K, optionally less than or equal to about 0.3 W/m·K, optionally less than or equal to about 0.1 W/m·K, optionally less than or equal to about 90 mW/m·K, optionally less than or equal to about 80 mW/m·K, optionally less than or equal to about 70 mW/m·K, optionally less than or equal to about 60 mW/m·K, optionally less than or equal to about 50 mW/m·K, optionally less than or equal to about 40 mW/m·K, optionally less than or equal to about 30 mW/m·K, optionally less than or equal to about 20 mW/m·K, optionally less than or equal to about 10 mW/m·K, optionally less than or equal to about 5 mW/m·K, and in certain aspects, optionally less than or equal to about 1 mW/m·K.

In certain variations, the thermal conductivity is greater than or equal to about 0.3 mW/m·K to less than or equal to about 0.5 W/m·K. In certain variations, an overall thermal conductivity of the partition assembly is similar to or the same as the thermal conductivity levels of the insulating materials by virtue of incorporating such materials into the insulating region(s) of the partition assembly.

In certain aspects, the high-strength thermally insulative partition assembly includes a metal structure. The assembly may include a plurality of insulating regions and/or a plurality of metal structures. The metal structure provides the high-strength thermally insulative partition assembly with strength and robustness for use in the harsh pressure and temperature conditions to which a partition or muffler plate is exposed. In certain variations, the metal structure has a thickness of greater than or equal to about 1 mm to less than or equal to about 15 mm. Suitable metals may include steel and any equivalents thereof. Where the assembly has a plurality of metal structures, the metal structures may be formed of the same metal or from distinct metals.

Thus, in one variation, a high-strength thermally insulative partition assembly (e.g., muffler plate) for a scroll compressor comprises a metal plate structure and an insulating region integral with the metal plate structure, where the insulating region has an average thermal conductivity (K) of less than or equal to about 300 mW/m·K at standard temperature and pressure conditions and the high-strength thermally insulative partition assembly has a tensile strength of greater than or equal to about 35,000 psi (about 241 MPa). The insulating region may comprise an insulating material or may define a low pressure or vacuum chamber in other variations. An insulating region that is integral with the metal plate structure may mean that the metal plate structure defines an insulating region, for example, sandwiching an insulating material in a core region or creating a low pressure or vacuum chamber in a core region. In other aspects, an integral insulating region is attached or coupled to the metal plate structure, for example, by being coated on one or more surfaces of the metal plate or having a physical or mechanical interlock or a mold-in feature between both components in the discharge region so that the insulating region is slidably received and secured to the metal plate structure.

The metal structure may sandwich the insulating region, in certain variations. In other aspects, the high-strength thermally insulative partition assembly has a first metal structure and a second distinct metal structure, where the insulating region is a chamber or region disposed between the first metal structure and the second metal structure. The first metal structure and the second metal structure may be plates that are joined together to sandwich a core or interior region that will define the insulating region. In other aspects, a single metal structure may have a core or interior region formed therein that defines an insulating region. Alternatively, a single metal structure may have an insulating region that is formed on one or more external surfaces of the metal structure(s). For example, in certain aspects, the thermally insulating material may be a coating, which may be disposed on an upper and lower surface of a metal or other structure of the partition assembly. In other variations, the insulating region may be a void, for examples, a low-pressure chamber or a vacuum chamber, which may also be filled with inert gas or gases. Where the partition assembly has a plurality of insulating regions, the insulating regions may contain the same insulating materials or distinct insulating materials (or alternatively, may include a low-pressure or vacuum chamber in one region in combination with a thermally insulating material in another region).

In other variations, the insulating region may be filled with a thermally insulating material. Suitable examples of thermally insulating materials have a thermal conductivity levels as described above. In certain variations, the thermally insulating material may be a layer, such as a polymeric coating. In other variations, the insulating material may be a composite comprising a resin and a reinforcement phase that includes a thermally insulating material. Such a composite may be a coating or a structural material (such as by molding techniques). In other variations, the insulating material may be foam, for example, a polymeric matrix material having a gas insufflated and distributed therein. In certain variations, the thermally insulating material may be an expanded-foam insulation having a cellular structure formed by evolving gas during the manufacture of foam. The foam may also be a composite foam including a polymeric matrix material having one or more reinforcement phases and insufflated gas distributed therein. The thermal conductivity of the foam insulations depends upon the gas used to foam the insulation plus a contribution due to internal radiant heat transfer and solid conduction.

In certain variations, the thermally insulating material for the insulating region according to the present disclosure comprises an expanded foam material (e.g., Rubber, Silica, Glass, Polyurethane), a gas-filled powders or fibrous insulating materials (e.g., Silica aero gel, fiberglass, Rockwool), opacified powders and/or evacuated powders (e.g., Calcium Silicate, Lampblack). The primary mechanism for insulation in glass-filled powders and fibrous materials is the reduction or elimination of convection due to the small size of the voids within the material. Yet other suitable thermally insulating materials include evacuated-powder and fibrous insulating materials. Gaseous conduction is one of the primary modes of heat transfer within powder and fibrous insulation materials. Some of the examples of suitable the insulation materials with thermal conductivity levels are listed below in the Table 1.

TABLE 1

| Insulating Material | Thermal Conductivity (mW/m · K) |
|---|---|
| TEFLON ™ PTFE | 300 |
| Silica | 55 |
| Rubber | 36 |
| Glass | 35 |
| Rock wool | 35 |
| Polyurethane | 33 |
| Fiberglass | 25 |
| Silica aerogel | 19 |
| Lampblack | 1.2 |
| Fine Perlite | 0.95 |
| Evacuated Calcium Silicate | 0.59 |

In certain aspects, the insulating material is selected from the group consisting of: polymers, polymeric composites, foam, and combinations thereof. In certain other variations, the thermally insulating material for the insulating region according to the present disclosure comprises a material selected from the group consisting of: fluoropolymers, such as polytetrafluoroethylene (PTFE), including TEFLON® PTFE that is commercially available from DuPont, polyurethane, polyamides, such as nylon, rubber and elastomers, silica, glass, gas-filled powders or fibers, such as aerogels, perlite, including fine perlite, vermiculite, rock wool, lampblack, evacuated calcium silicate, other evacuated powders, opacified powders, and combinations thereof.

In yet another variation, a method of operating a scroll compressor is provided. The method may comprise introducing a low-pressure refrigerant into a peripheral suction zone of a compression mechanism comprising a first scroll member having a discharge port and a first spiral wrap and a second scroll member having a second spiral wrap. The first and second spiral wraps are mutually intermeshed to create at least one enclosed space of progressively changing volume for compression between the peripheral suction zone and the discharge port to create a high-pressure refrigerant. The method further includes compressing the low-pressure refrigerant in the compression mechanism by orbiting the second scroll member with respect to the first scroll member to create a high-pressure refrigerant that exits through the discharge port of the first scroll member into a discharge chamber. A high-strength thermally insulative partition assembly is disposed between the first scroll member and the discharge chamber. The high-strength thermally insulative partition assembly comprises a metal plate and an insulating region having a thermal conductivity (K) of less than or equal to about 300 mW/m·K at standard temperature and pressure conditions. The high-strength thermally insulative partition assembly has a tensile strength of greater than or equal to about 35,000 psi (about 241 MPa). While the quantity of heat transfer that is prevented or minimized varies depending on the compressor capacity and size, in one exemplary embodiment, the high-strength thermally insulative partition assembly minimizes or prevents heat transfer to less than or equal to about 350 W at Air-Conditioning and Refrigeration Institute (ARI) Standard operating conditions between the high-pressure refrigerant in the discharge chamber and the low-pressure refrigerant in the peripheral suction zone. The ARI standard conducts testing at 45°/130°/65° F. operating conditions. In certain aspects, the high-strength thermally insulative partition assembly in such a compressor minimizes or prevents heat transfer to less than or equal to about 500 W, optionally less than or equal to about 750 Watts. In certain other aspects, a high-strength thermally insulative partition assembly in a scroll compressor can provide an increased capacity gain for the scroll compressor from greater than or equal to about 2% up to greater than 9% as compared to the same scroll compressor having a conventional muffler separator plate. Further, in certain variations, a scroll compressor having high-strength thermally insulative partition assembly can provide a decrease in power consumption at standard operating conditions (e.g., ARI conditions or CHEER conditions, discussed further below) of greater than or equal to about 3%, optionally greater than or equal to about 4%, optionally greater than or equal to about 5% of power consumption, as compared to the same scroll compressor having a conventional muffler separator plate.

FIGS. 3 and 4 show a scroll compressor 100 incorporating a high-strength thermally insulative separator or partition assembly according to certain aspects of the present disclosure. For brevity, unless otherwise discussed herein, to the extent that the components in the following embodiments and the accompanying figures are the same as those described in the context of FIG. 1, the components can be assumed to have the same configuration and function and will not be expressly discussed herein. A separator or partition assembly 110 (e.g., muffler plate) divides the high-side discharge chamber 42 from low-side inlet chamber 94. After the fluid is processed and compressed in the spiral vanes 72, 82, it is then released through the discharge passage 74 (which has reed valve assembly 78). Partition assembly 110 includes an opening 112, through which compressed fluid (exiting the non-orbiting scroll 70) can pass as it enters the discharge chamber 42. Partition assembly 110 includes a first metal structure or upper plate 120 and a second metal structure or lower plate 122. The upper plate 120 and the lower plate 122 sandwich an insulating material 130 therebetween to define an insulating region 132. The insulating material 130 may be any of those discussed previously above. Thus, the insulating material 130 may be pre-formed and then sandwiched between the upper plate 120 and lower plate 122 to form the insulating region 132. Alternatively, the upper plate 102 and the lower plate 132 may be placed together to form an open cavity corresponding to the insulating region 132. The insulating material 130 may be then introduced into the open cavity corresponding to the insulating region 132.

In certain aspects, an optional ring 134 is used to seal the insulating region 132 from the exterior environment. The ring 134 may be disposed between the upper plate 120 and lower plate 122 along respective inner circumferential edges around the opening 112. The ring 134 may be formed of a different material than the insulating material 130 and may serve to seal the insulating region 132 from refrigerant or other materials. In certain aspects, the ring may be a polymer, such as an elastomer, or it may be a metal. In other aspects, the ring may be a metal material that fuses the upper plate 120 to the lower plate 122 (e.g., a brazing material, solder, or the like).

The upper plate 120 may be joined and sealed to the lower plate 122 at a peripheral region 136. As noted above, the shell 22 includes upper cap 24 that is joined or welded to lower shell portion 25. At least a portion of the partition assembly 110 may be joined or welded to the upper cap 24 and lower shell portion 25 at the peripheral region 136. As best shown in FIG. 4, the peripheral region has a design such that lower plate 122 of the partition assembly 110 transversely extends beyond the terminal end 138 of upper plate 120. Thus the lower plate 122 is joined (e.g., via welding) to the upper cap 24 and lower shell portion 25.

Figure 5:
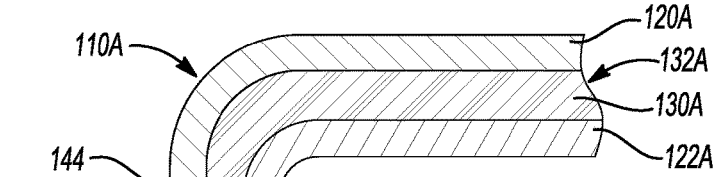
FIG. 5 shows a fillet weld design for a peripheral region of a high-strength thermally insulative partition assembly in accordance with certain aspects of the present disclosure.

Other peripheral region weld designs may be employed with a partition assembly in accordance with the present disclosure. For example, one variation of a fillet welding design for a peripheral region 136A of a partition assembly 110A is shown in FIG. 5. The partition assembly 110A has an upper plate 120A, a lower plate 122A, and an internal insulating region 132A having an insulating material 130A disposed therein. The upper plate 120A has a terminal edge 138A. The lower plate 122A extends laterally to define a projection 140 beyond the terminal edge 138A, which seats against the lower plate 122A so that the upper plate 120A and lower plate 122A are orthogonal to one another. A fillet type weld joint 142 is formed between the lower plate 122A and an external surface 144 of the upper plate 120A. Such fillet type weld joint 142 may extend around a circumference of the peripheral region 136A, which is thus welded and sealed. Such a fillet type weld joint 142 may be preformed and then later the partition assembly 110A attached to the shell 22 (as shown in FIGS. 1-3), or the fillet type weld joint 142 may concurrently weld the partition assembly 110A to one or more portions of shell 22.

Figure 6:
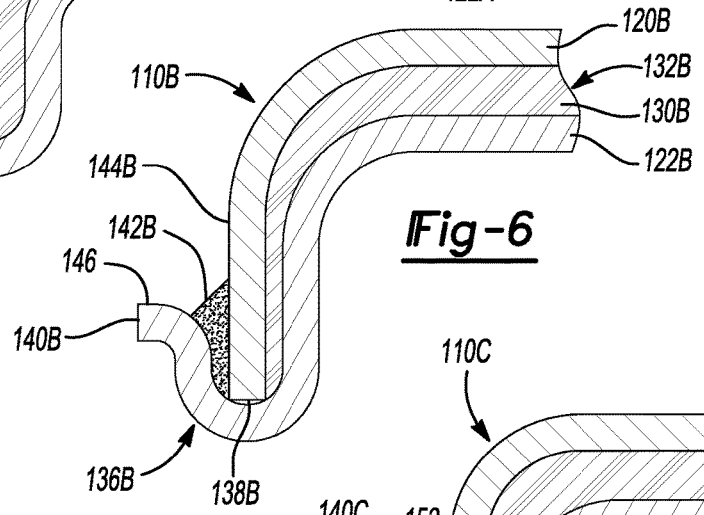
FIG. 6 shows a lap weld design for a peripheral region of a high-strength thermally insulative partition assembly in accordance with certain other aspects of the present disclosure.

Another weld design may be a lap weld design for a peripheral region 136B of a partition assembly 110B is shown in FIG. 6. The partition assembly 110B has an upper plate 120B, a lower plate 122B, an internal insulating region 132B having an insulating material 130B disposed therein. The upper plate 120B has a terminal edge 138B. The insulating material 130B is thinner in the peripheral region 136B, so that it narrows in thickness between the lower plate 122B and an outer surface 144B of the upper plate 120B near the terminal edge 138B. The lower plate 122B extends laterally to define a projection 140B that extends beyond the terminal edge 138B. The projection 140B of lower plate 122B fully wraps around the terminal edge 138B of upper plate 120B and defines a lip 146. The projection 140B bends in such a manner that a lap type weld joint 142B is thus formed between the outer surface 144B of the upper plate 120B and the curved portion of projection 140B adjacent to lip 146.

Figure 7:
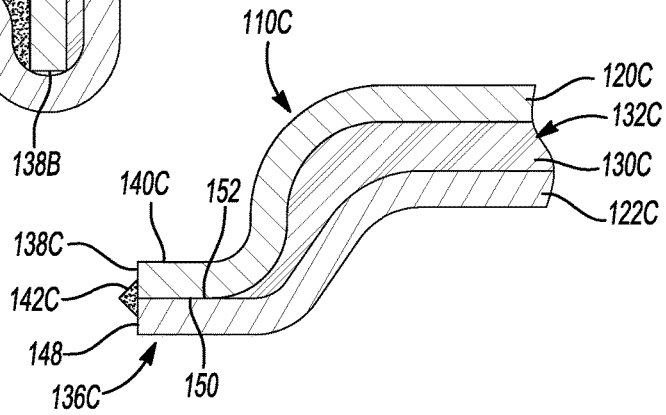
FIG. 7 shows a butt weld design for a peripheral region of a high-strength thermally insulative partition assembly in accordance with yet other aspects of the present disclosure.

Yet another weld design may be a butt weld design for a peripheral region 136C of a partition assembly 110C is shown in FIG. 7. The partition assembly 110C has an upper plate 120C, a lower plate 122C, and an internal insulating region 132C having an insulating material 130C disposed therein. The upper plate 120C has a terminal edge 138C, while the lower plate 122C has a terminal edge 148. The insulating material 130C is thinner in the peripheral region 136C, so that it narrows in thickness as it approaches the terminal edge 148 of lower plate 122C and the terminal edge 138C of upper plate 120C. Both the upper plate 120C and the lower plate 122C extend laterally and in parallel to one another in the peripheral region 136C. Thus, inner surface 150 of upper plate 120C and inner surface 152 of lower plate 122C contact one another at the peripheral region 136C. A butt type weld joint 142C is thus formed across at least a portion of terminal edge 148 of lower plate 122C and terminal edge 138C of upper plate 120C.

Figure 8:
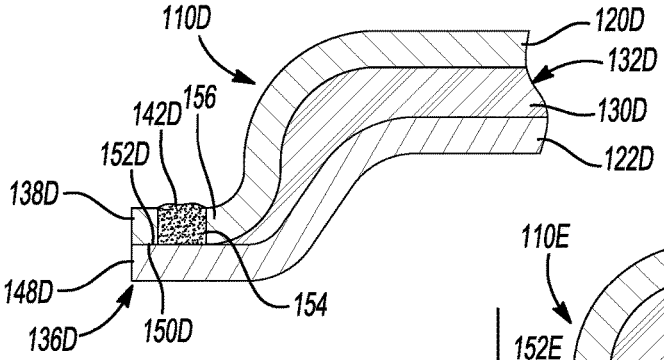
FIG. 8 shows an insert weld design for a peripheral region of a high-strength thermally insulative partition assembly in accordance with certain aspects of the present disclosure.

FIG. 8 shows another weld design that involves insert welding. A partition assembly 110D defines a peripheral region 136D. The partition assembly 110D has an upper plate 120D, a lower plate 122D, and an internal insulating region 132D having an insulating material 130D disposed therein. The upper plate 120D has a terminal edge 138D, while the lower plate 122D has a terminal edge 148D. The insulating material 130D is thinner in the peripheral region 136D, so that it narrows in thickness as it approaches the terminal edge 148D of lower plate 122D and the terminal edge 138D of upper plate 120D. Both the upper plate 120D and the lower plate 122D extend laterally and in parallel to one another in the peripheral region 136D. Thus, an inner surface 150D of upper plate 120D and an inner surface 152D of lower plate 122D contact one another at the peripheral region 136D. The upper plate 120D may define an opening 154 for receiving a consumable welding insert 156. The opening 154 may include a continuous ring or groove structure, or alternatively may include a plurality of openings 154 distributed evenly and at regular intervals around the circumference of the partition assembly 110D. The consumable welding insert 156 may be a preformed metal material that is fused and becomes part of a weld joint 142D. Thus, the consumable welding insert 156 may be a continuous structure (e.g., a ring that seats in a circumferential groove opening 154) or discrete inserts (e.g., pegs that seat in discrete openings 154 disposed).

Figure 9:
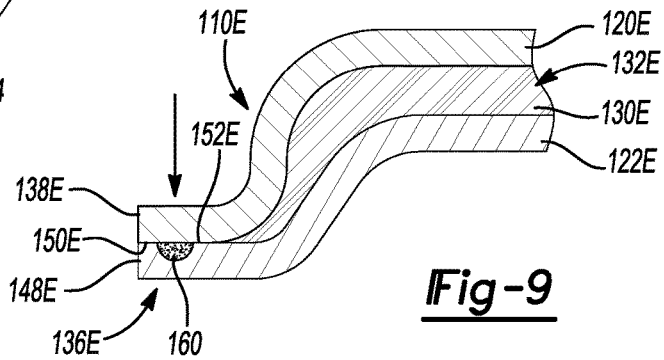
FIG. 9 shows a resistance weld design for a peripheral region of a high-strength thermally insulative partition assembly in accordance with certain other aspects of the present disclosure.

Yet another weld design may be a lap weld design for a peripheral region 136E of a partition assembly 110E is shown in FIG. 9. The partition assembly 110E has an upper plate 120E, a lower plate 122E, an internal insulating region 132E having an insulating material 130E disposed therein. The upper plate 120E has a terminal edge 138E. The insulating material 130E is thinner in the peripheral region 136E is thinner in the peripheral region 136E, so that it narrows in thickness as it approaches the terminal edge 148E of lower plate 122E and the terminal edge 138E of upper plate 120E. Both the upper plate 120E and the lower plate 122E extend laterally and in parallel to one another in the peripheral region 136E. Thus, an inner surface 150E of upper plate 120E and an inner surface 152E of lower plate 122E contact one another at the peripheral region 136E. A resistance welding technique may be used to pass current through the upper and lower plates 120E, 122E to form a resistance weld nugget 160 that defines a welded joint. In certain aspects, the resistance weld nugget 160 may be continuous and forms a line or ring around the circumference of the peripheral region 136E or alternatively may include a plurality of discrete weld nuggets 160 distributed at regular intervals around the circumference of the peripheral region 136E.

Another variation of a high-strength thermally insulative separator or partition assembly 200 is shown in FIG. 10 having a variation of a mechanical interlock system for joining a metal structure to a polymeric insulating component. The assembly 200 includes an insulating region in the form of an insulating component or mask 210 that is a molded plate. The insulating mask 210 is attached or joined with a metal plate 230. The insulating mask 210 comprises a body portion 212 that seats against a body portion 232 of the metal plate 230. The body portion 212 includes angled sides 214 and a flat upper region 216. The flat upper region 216 has a first centrally disposed aperture 218. As shown, the first centrally disposed aperture 218 is seated within concentric depressions 220 that are recessed from a plane of the flat upper region 216. The insulating mask 210 includes an extended tubular region 222 corresponding to the first centrally disposed aperture 218. The extended tubular region 222 thus extends towards the metal plate 230 terminating in a protruding flange 224 that extends radially outward towards the angled sides 214. A seat 226 is thus defined along the extended tubular region 222 between the protruding flange 224 and concentric depressions 220.

The body portion 232 of metal plate 230 likewise defines angled sides 234, a flat upper region 236, and a terminal edge 242. Terminal edge 242 may have a protruding ring 244 that can attach the housing or shell of the compressor via a peripheral region weld, as described above. A second centrally disposed aperture 238 is formed in flat upper region 236. The second centrally disposed aperture 238 terminates in a lip 240. Flat upper region 236 likewise has concentric depressions 242. The shape of the body portion 232 is generally conformal to the shape of the body portion 212 of insulating mask 210.

The extended tubular region 222 of insulating mask 210 may terminate in flexible slats or tabs 228 that permit radial compression as the extended tubular region 222 is forced downwards through the second centrally disposed aperture 238 during an assembling process. The insulating mask 210 is conformal in shape to the metal plate 230 up to the angled sides 234, although as shown in FIG. 10, ends prior to the terminal edge 242 that can be physically attached to the housing or shell of the compressor. When the insulating mask 210 is seated against the metal plate 230, the lip 240 has a height and dimension such that it is securely seated within seat 226 along the extended tubular region 222 between the protruding flange 224 and concentric depressions 220 of insulating mask 210. In this manner, a mechanical interlock is formed between the insulating mask 210 and the metal plate 230 to form the high-strength thermally insulative separator or partition assembly 200. Thus, the insulating region is slidably received and secured to the metal plate structure in the discharge region via the mechanical interlock, permitting a quick-fitting assembly technique. Adhesives may be used to further secure the insulating mask and metal plate 230 together. Notably, additional or other mechanical interlocks are likewise contemplated. Further, a mold-in feature or an insert molding technique that forms a single piece may be used. Further, the insulating mask 210 may be designed to fit on the opposite side of the metal plate 230. As appreciated by those of skill in the art, the insulating mask 210 and metal plate 230 may have different complementary shapes or surface contours than those shown.

The insulating mask 210 is thus pre-formed and may be formed of an insulating material, such as a polymeric material that has the desired thermal conductivity levels, desired robustness and strength at discharge temperatures and pressures, and flexibility to permit the tabs 228 to flex during radial compression and assembly. Such a pre-formed component provides high strength. One particularly suitable material is an aliphatic polyamide like nylon-66, although any other refrigerant-compatible polymers having a minimum strength of greater than or equal to about 45 MPa are likewise contemplated. Such a pre-formed insulating mask 210 can be molded into the desired shape, for example, by injection molding. In certain variations, although thickness may vary in different regions of the body portion 212, the pre-formed insulating mask 210 may have a maximum thickness of greater than or equal to about 0.5 mm to less than or equal to about 10 mm, optionally greater than or equal to about 0.75 mm to less than or equal to about 5 mm, and in certain aspects, greater than or equal to about 1 mm to less than or equal to about 3 mm. The metal plate 230 may likewise be preformed into the desired shape, for example, by casting, die-casting, forging, sintering power metal, which and the like. Such formation processes may further involve machining of the metal structure.

Another variation of a high-strength thermally insulative separator or partition assembly 300 is shown in FIG. 11 having a different variation of a mechanical interlock system for joining a metal structure to a polymeric insulating component than in FIG. 10. The assembly 300 includes an insulating region in the form of an insulating component or mask 310 that is formed as a molded plate. The insulating mask 310 is attached or joined with a metal plate 330. The insulating mask 310 comprises a body portion 312 that seats against a body portion 332 of the metal plate 330. The body portion 312 includes angled sides 314 and a flat upper region 316. The flat upper region 316 has a first centrally disposed aperture 318. As shown, the first centrally disposed aperture 318 is seated within concentric depressions 320 that are recessed from a plane of the flat upper region 316. A plurality of undercut protrusions 322 is formed on an inner surface 324 of the insulating mask 310. The inner surface 324 of insulating mask 310 is seated against an upper surface 333 of metal plate 330.

The body portion 332 of metal plate 330 likewise defines angled sides 334, a flat upper region 336, and a terminal edge 340. Terminal edge 340 may have a protruding ring 342 that can attach to the housing or shell of the compressor via a peripheral region weld, as described above. A second centrally disposed aperture 338 is formed in flat upper region 336. The second centrally disposed aperture 338 terminates in a lip 344. Flat upper region 336 likewise has concentric depressions 350. A plurality of undercut slots 352 is formed on an upper surface 334 of the insulating mask 310. The shape of the body portion 332 is generally complementary to the shape of the body portion 312 of insulating mask 310. The insulating mask 310 thus conforms to the metal plate 230 along the angled sides 334. As shown in FIG. 11, insulating mask 310 terminates before the terminal edge 342 of the metal plate 330 that can be physically attached to the housing or shell of the compressor. In this variation, when the insulating mask 310 is seated against the metal plate 330, the lip 344 protrudes downwards. The concentric depressions 320 of insulating mask 310 sits flush against the concentric depressions 350 of insulating mask 310. As appreciated by those of skill in the art, the insulating mask 310 and metal plate 330 may have different complementary shapes or surface contours than those shown.

The plurality of undercut protrusions 322 thus mate with and are seated and locked in the undercut slots 352. The inner surface 324 of insulating mask 310 can be locked or secured into position against the upper surface 333 of metal plate 330 by use of such mechanical interlocks in the form of the undercut protrusions 322 and undercut slots 352. In this manner, the high-strength thermally insulative separator or partition assembly 300 is formed. Thus, the insulating mask 310 is slidably received and secured to the metal plate 330 structure via the mechanical interlock, permitting a quick-fitting assembly technique. Adhesives may be used to further secure the insulating mask 310 and metal plate 330 together. Notably, other mechanical interlocks and physical connections are likewise contemplated. Further, the insulating mask 310 may be designed to have a shape that fits on the opposite side of the metal plate 330. The insulating mask 310 and metal plate 330 may be formed of the same materials and by the same processes as described above for insulating mask 210 and metal plate 230 in the context of FIG. 10.

Another variation of a high-strength thermally insulative separator or partition assembly 600 is shown in FIG. 12 having a metal plate structure with two insulating regions in the form of surface coatings. The assembly 600 includes a metal plate 602, a first insulating region 610, and a second insulating region 612. In this variation, the first and second insulating regions 610, 612 are coatings formed on and attached to an upper surface 604 and a lower surface 606 of metal plate 602. The first and second insulating regions 610, 612 are formed of an insulating material. The insulating material may be a polymeric material that has the desired thermal conductivity levels, desired robustness and strength at discharge temperatures and pressures, such as those comprising a polymer previously described above. One particularly suitable material is polytetrafluoroethylene (PTFE) commercially available as TEFLON™. Any other refrigerant-compatible polymers are likewise contemplated. For example, the insulating material may be a composite polymeric coating, as well. Different select regions of the metal plate 602 may be coated with such the first and second insulating regions 610, 612; however, the coatings are disposed in regions that minimize heat transfer across the assembly 600 (from a high-side to a low-side within the scroll compressor). The first and second insulating regions 610, 612 may be formed of the same insulating material composition or may be formed of distinct insulating material compositions. Furthermore, the first and second insulating regions 610, 612 may in alternative variations be a single contiguous coating that extends across the centrally disposed aperture 630 surface.

As shown, the metal plate 602 defines angled sides 634, a flat upper region 636, and a terminal edge 640. A centrally disposed aperture 630 is seated within concentric depressions 620 that are recessed from a plane of the flat upper region 636. Terminal edge 640 may have a protruding ring 642 that can attach the housing or shell of the compressor via a peripheral region weld, as described above. The first and second insulating regions 610, 612 attach to and conformal with the shape of the metal plate 602. As with the other embodiments, the metal plate 602 may have different shapes or surface contours than those shown. The first and second insulating regions 610, 612 extend from the centrally disposed aperture 630 to the angled sides 634, although as shown in FIG. 12, both the first and second insulating regions 610, 612 end prior to a terminal edge 240 that can be physically attached to the housing or shell of the compressor. The first and second insulating regions 610, 612 may be applied to the surface as precursors of an insulating polymeric coating. For example, the precursor(s) of such insulating region coatings may be applied via painting, liquid spraying, electrostatic spraying, casting, dipping, and the like. Then, the precursors may be dried (to remove one or more liquid carriers) and optionally cured or cross-linked, for example, by using actinic radiation, E-beam curing, or elevated temperatures. In certain variations, although thickness of the first and second insulating regions 610, 612 may vary slightly, the first and second insulating regions may have a maximum thickness of greater than or equal to about 10 micrometers (μm) to less than or equal to about 100 μm, optionally greater than or equal to about 25 μm to less than or equal to about 75 μm, and in certain aspects, greater than or equal to about 40 μm to less than or equal to about 60 μm. In certain variations, a suitable thickness for each respective insulating coating may be about 50 μm. The insulating region coatings on a metal plate may be somewhat limited in certain applications, due to restrictions on upper ranges of thicknesses and overall strength of the coating, as compared to a structural insulating component like in FIGS. 10-11 or other designs having higher strength (e.g., sandwiching the insulating region like in FIGS. 3-4), by way of non-limiting example. Thus, such variations with insulating region coatings may be particularly suitable to scroll compressor applications that experience relatively lower temperature and pressure conditions.

In certain variations like that shown in FIG. 20, a partition assembly 650 according to certain variations of the present disclosure is provided that avoids placing the insulating regions along the edges. Thus, a first insulating region 660 and/or a second insulating region 662 may be omitted from an edge region 670 near a terminal edge 672 (e.g., by masking during application of precursors of the coatings) or removed from the edge region 670 after application. Due to heating during welding, the insulating material in the insulating regions 660, 662 may be damaged as heat spreads from the weld zone after the weld is made. Thus, in certain variations, first insulating region 660 and/or a second insulating region 662 are removed from the edge region 670 prior to welding of the partition assembly 650 to the scroll compressor housing or shell.

FIGS. 13 and 14 show schematics of heat transfer mechanisms. FIG. 13 shows a heat transfer mechanism through one embodiment according to the present disclosure of a high-strength thermally insulative separator or partition assembly 110 like in FIGS. 3-4. FIG. 14 shows a heat transfer mechanism through another variation of a high-strength thermally insulative separator or partition assembly 200 like in FIG. 10. As shown $T_d$ is a discharge temperature within a discharge chamber. $T_s$ is a suction temperature corresponding to a temperature in an inlet chamber. $T_{F\text{-}1}$ is a refrigerant temperature along an upper surface (400 in FIGS. 13 and 410 in FIG. 14) of the assembly 110 and assembly 200, respectively. $T_{F\text{-}2}$ is a refrigerant temperature along a lower surface (402 in FIGS. 13 and 412 in FIG. 14) of the assembly 110 and assembly 200, respectively. As can be seen, the lower the thermal conductivity of the assembly (e.g., 100 or 200), the less heat transfer via conduction and heat transfer occurs, minimizing any increases in $T_{F\text{-}2}$ and $T_s$ temperatures. Reducing the amount of transferred heat minimizes any increase in the suction gas temperature $T_s$.

FIG. 15 shows another variation of a high-strength thermally insulative separator or partition assembly 500 comprising a metal structure sandwiching an insulating vacuum chamber according to certain variations of the present disclosure. The partition assembly 500 includes an opening 512, through which compressed fluid can pass after being compressed. Partition assembly 500 includes a first metal structure or upper plate 520 and a second metal structure or lower plate 522. The upper plate 520 and the lower plate 522 define an insulating region 530 therebetween. An optional ring 534 is used to seal the insulating region 530 from the external environment. The ring 534 may be disposed between the upper plate 520 and lower plate 522 along respective inner circumferential edges around the opening 512. In certain aspects, the ring may be a polymer, such as an elastomer, or it may be a metal. In other aspects, the ring may be a metal material that fuses the upper plate 520 to the lower plate 522 (e.g., a brazing material, solder, or the like).

In this variation, the insulating region 530 may be a low-pressure or vacuum chamber. The low-pressure chamber may be filled with an inert or insulating gas at low pressures, such as argon, krypton, xenon, and mixtures thereof. Suitable vacuum level pressures may be less than or equal to about $10^{-2}$ Torr. The insulating material 130 may be any of those discussed previously above. The upper plate 520 and the lower plate 522 may be placed together to form an open cavity corresponding to the insulating region 132. The insulating region 132 may be filled with an inert insulating gas or a vacuum may be drawn to create the vacuum chamber. After reducing pressure in the insulating region 132, a port or aperture 532 may be sealed to create a vacuum seal.

Various embodiments of the present disclosure can be further understood by the specific examples contained herein. Specific examples are provided for illustrative purposes of how to make and use the compositions, devices, and methods according to the present teachings and, unless explicitly stated otherwise, are not intended to be a representation that given embodiments of this invention have, or have not, been made or tested.

EXAMPLES

Comparative Example 1—Heat Flow Calculations: Conventional Muffler Partition Plate without Insulation Comparative Example 1 is an estimated heat loss across a conventional metal muffler plate from a discharge side to suction side. Theoretical heat transfer is calculated and based on basic heat transfer processes of conduction and convection. Such a heat transfer mechanism for a conventional partition or muffler plate is also based on the mechanism shown in FIG. 2.

In this test model, input parameters for a scroll compressor (ZP21K5E-PFV) processing R410A refrigerant (a hydrofluorocarbon refrigerant comprising a near-azeotropic mixture of difluoromethane (HFC-32) and pentafluoroethane (HFC-125)) at ARI conditions (45°/130°/65° F.) are used to perform simulation calculations. The thermal conductivity of the conventional steel muffler plate is 65.2 W/m·K. Based on component dimensions and parameters in the scroll compressor, a resistance to heat transfer of the muffler plate ($R_{muffler}$) is calculated to be equal to 0.001242 K/W. A total resistance to heat transfer, including $R_{muffler}$ and convection, is calculated to be is 0.091 K/W. Thus, a Total Heat Conduction (Q) is calculated to be 807.2 W. This result means that 807.2 Watts of heat transfer across a conventional uninsulated muffler or partition plate.

Example 2—Heat Flow Calculations: Inventive Muffler Partition Plate Having PTFE Insulation Heat loss across an insulated muffler plate prepared in accordance with certain aspects of the present disclosure having a polytetrafluoroethylene (PTFE) insulating region (referred to herein as Example 2) from a discharge side to suction side of the same ZP21K5E-PFV scroll compressor using R410A refrigerant at ARI conditions is estimated as follows, similar to the calculations discussed above for Comparative Example 1. The PTFE used is TEFLON™ commercially available from DuPont, which is sandwiched between an upper plate and a lower plate, similar to the design described in the context of FIGS. 3-4.

In this test model, input parameters for a scroll compressor (ZP21K) processing R410A refrigerant (a hydrofluorocarbon refrigerant comprising a near-azeotropic mixture of difluoromethane (HFC-32) and pentafluoroethane (HFC-125)) at ARI conditions include thermal conductivity of a TEFLON™ coating of 0.30 W/m·K. A total resistance to heat transfer is 0.10 K/W. A Total Heat Conduction (Q) is calculated to be 706.5 W. This result means that for Example 2, only 706.5 Watts of heat transfer across an insulated partition assembly comprising PTFE coatings, while the conventional uninsulated muffler plate in Comparative Example had a heat transfer of 807.2 Watts. The inventive muffler assembly plates of Example 2 thus provide an approximate reduction in heat transfer of about 12.5%, as compared to conventional muffler plates of Comparative Example 1.

Further experimental testing of compressors is conducted to validate the proposed design and theoretical calculations above. A compressor (Model ZP21K5E-PFV) is tested to verify the efficiency gain. The testing is done at key operating points to evaluate the performance of scroll compressors according to different standards, for example, measuring compressor performance at a predetermined saturated evaporating temperature, a predetermined saturated condensing temperature, and a predetermined suction gas temperature. One such standard is an Air-Conditioning and Refrigeration Institute (ARI) Standard (45°/130°/65° F.?). Another rating standard is CHEER (45°/100°/65° F.), which more closely approximates the conditions under which the compressor will operate most frequently. Another empirical performance rating (OP) is used to assess more typical compressor operating conditions to assess the efficiency benefit.

A summary of the various test results at different ARI, CHEER, and OP conditions is shown in Table 2 below.

TABLE 2

| | | EER % of Gain/Loss | |
|---|---|---|---|
| | Test Condition | Theoretical Calculations | Experimental Testing |
| 1 | ARI | 2.9 | 3.9 |
| 2 | CHEER | 0.9 | 0.5 |
| 3 | OP | 12.6 | 8.3 |

Based on this experimental testing, inventive Example 2 demonstrates an energy efficiency ratio (EER) gain of 3.9% at ARI conditions over current EER for Comparative Example 1. Capacity has been increased by 3.6% for Example 2 as compared to Comparative Example 1, while the power consumed remains the same. In addition to capacity and EER gain, the upper shell temperature of Example 2 is reduced considerably by about 6° F. At more typical operating conditions, a performance gain of up to 8% is seen for Example 2 versus Comparative Example 1. However, at lower pressure differential (CHEER) conditions, while there is still a performance benefit between Example 2 and Comparative Example 1, it is not as great as at OP or ARI conditions.

Thus, according to certain aspects of the present disclosure, these comparative results demonstrate that there is more benefit when higher pressure and temperature discharge gas is used. With the increase in suction gas superheating, the thermal resistance of an insulative TEFLON™ PTFE coating to conduct heat across muffler plate is greater. Due to this, a total power saving of 10 W has been observed for certain compressor operating conditions. The main indicator of suction gas is a Mid-Shell temperature, which is observed to be reduced by at least 13° F. with certain designs according to the present disclosure.

Example 3—Heat Flow Calculations: Inventive Muffler Partition Plate Having Nylon-66 Insulation Heat loss across an insulated muffler plate assembly prepared in accordance with certain aspects of the present disclosure like that in FIG. 10 having a nylon-66 mask insulating region (referred to herein as Example 3) from a discharge side to suction side is estimated as follows, similar to the calculations discussed above for Comparative Example 1 and Example 2. A nylon-66 insulating mask is formed at a 1 mm thickness. In this test model, input parameters for a scroll compressor (ZP21K5E-PFV) processing R410A refrigerant (a hydrofluorocarbon refrigerant comprising a near-azeotropic mixture of difluoromethane (HFC-32) and pentafluoroethane (HFC-125)) at ARI conditions. Variables or parameters not listed can be assumed to be the same as those above in Example 2. A thermal conductivity of Nylon-66 is 0.25 W/m·K. A total resistance to heat transfer is calculated to be 0.22 K/W. A total heat conduction (Q) is 333 W. The calculated amount of heat transfer across the insulated muffler plate assembly having a nylon-66 mask insulating region in Example 3 is thus 333 Watts. This result means that for Example 3, only 333 Watts of heat transfer across an insulated partition assembly having a nylon-66 mask, while the conventional uninsulated muffler plate in Comparative Example had a heat transfer of 807.2 Watts. The inventive muffler assembly plates of such a design provide an approximate reduction in heat transfer of about 59%, as compared to conventional muffler plates. Further, Table 3 below provides a summary of heat transfer results at different test conditions for Example 3.

TABLE 3

| Operating Condition | Heat Flow Across Muffler Plate (W) Without Insulation | With Nylon-66 Insulation | % Reduction |
|---|---|---|---|
| ARI | 807.2 | 333 | 59% |
| CHEER | 406.4 | 236.7 | 42% |
| OP | 617.6 | 394.4 | 36% |

Similar compressor performance testing is conducted as described above in the context in Comparative Example 1 and Example 2. Comparative results (calculated and experimental) are shown in Table 4 below. A robust high-strength muffler plate assembly having two metal plates sandwiching an insulated region comprising TEFLON™ PTFE is also included for comparison. Another robust high-strength muffler plate assembly has a metal plate with a TEFLON™ PTFE coating on both an upper and lower surface of the metal plate, like a design shown in FIGS. 12 and 20.

TABLE 4

| Test Conditions | EER % of Gain/Loss: Theoretical Calculations (Example 2, muffler assembly sandwiching an insulated TEFLON ™) | Experimental Testing (muffler assembly with TEFLON ™ coating on each side of metal plate) | Theoretical Calculations (Example 3, muffler assembly with a nylon-66 insulating mask) |
|---|---|---|---|
| 1 ARI | 2.9 | 3.9 | 12.7 |
| 2 CHEER | 0.9 | 0.5 | 4.0 |
| 3 OP | 12.6 | 8.3 | 17.4 |

Therefore, a partition muffler plate assembly including a Nylon-66 insulating mask having a 1 mm thickness disposed on the top of a metal plate can provide particularly desirable heat transfer reduction and improved performance.

A graph showing EER improvement for a compressor including such a high-strength thermally insulative partition assembly is included in FIG. 16. In FIG. 16, TEFLON™ PTFE (Example 2) is compared to insulating nylon-66 masks having different thicknesses (with thicknesses of 1 mm (Example 3), 1.5 mm, and 2 mm, respectively). As can be seen, the greatest improvements in ARI, CHEER, and OP performance occur for the 2 mm thick nylon-66 mask.

In FIGS. 17-19, modeling for % change in efficiency is shown at different performance rating conditions (FIG. 17 is ARI Conditions, FIG. 18 is CHEER Conditions, and FIG. 19 is OP or normal operating conditions) for partition or muffler plate assemblies having different insulation materials in a single type of scroll compressor. As appreciated by those of skill in the art, such conditions may vary for different scroll compressors having different capacities or designs. Existing refers to a conventional metal muffler plate, as compared to partition assemblies formed in accordance with the present disclosure having metal plates sandwiching different insulating materials: TEFLON™ PTFE, silica, rubber, glass, rock wool, polyurethane, fiber glass, silica aerogel, and evacuated calcium silicate. Suction gas temperatures are also shown for these muffler plates. Table 5 also provides average heat transfer through inventive muffler plates incorporating insulating materials according to certain aspects of the present disclosure, as well as % reduction in ARI for a 1 mm thick material.

TABLE 5

| Insulating Material | Thermal Conductivity (mW/m · K) | Heat Transfer At ARI (Watts) | % Reduction for 1 mm Thickness |
|---|---|---|---|
| TEFLON ™ PTFE | 300 | 471.4 | 42 |
| Silica | 55 | 165.2 | 80 |
| Rubber | 36 | 116.4 | 86 |
| Glass | 35 | 113.6 | 86 |
| Rock wool | 35 | 113.6 | 86 |
| Polyurethane | 33 | 108 | 87 |
| Fiberglass | 25 | 84.5 | 90 |
| Silica aerogel | 19 | 65.9 | 92 |
| Lampblack | 1.2 | 4.5 | 99 |
| Fine Perlite | 0.95 | 3.6 | 100 |
| Evacuated Calcium Silicate | 0.59 | 2.2 | 100 |

As can be seen, the modeling predicts that expanded foams and gas-filled powders have lower thermal conductivity and thus provide improve performance by reducing an amount of heat transferred. An increase of 1-19% in EER is shown in FIGS. 17-19. In addition to EER gain, the suction gas temperature has been reduced considerably by 10-20° F. with the different insulation types according to the present disclosure. A maximum benefit is provided for OP operating conditions that experience maximum differential pressure conditions. Further, evacuated calcium silicate as an insulating material provides a particularly efficacious improvement in all conditions, including with CHEER tests.

As such, significant performance benefits are provided with a muffler plate assembly having TEFLON™ PTFE coatings as insulating regions on a metal plate in a welded compressor. More specifically, a capacity gain of 2-9% is observed in certain variations. Likewise, a decrease in power consumption up to 3% is observed, except at OP conditions.

The EER gain is significant, for example, about 3-7% when using such variations in a scroll compressor.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed:

1. A scroll compressor comprising:

a first scroll member having a discharge port and a first spiral wrap;

a second scroll member having a second spiral wrap, the first and second spiral wraps being mutually intermeshed to define a peripheral suction zone in fluid communication with an inlet that receives low-pressure refrigerant;

a high-strength thermally insulative partition assembly comprising a metal plate and an insulating region that is disposed between the first scroll member and a discharge chamber in fluid communication with the discharge port, wherein the insulating region comprises a distinct mask component secured to the metal plate via a mechanical interlock or a mold-in feature and that has a thermal conductivity (K) of less than or equal to about 300 mW/m·K at standard temperature and pressure conditions, wherein the mask component defines a first discharge portion that defines a seat and comprises a plurality of tabs that radially compress in a first position for sliding engagement with a second discharge portion on the metal plate, wherein the second discharge portion is secured within the seat of the first discharge portion after expansion of the plurality of tabs to a second position and the high-strength thermally insulative partition assembly has a tensile strength of greater than or equal to about 35,000 psi (about 241 MPa); and a motor for causing the second scroll member to orbit with respect to the first scroll member, whereby the first spiral wrap and the second spiral wrap create at least one enclosed space of progressively changing volume between the peripheral suction zone and the discharge port to create a high-pressure refrigerant, wherein the high-strength thermally insulative partition assembly minimizes or prevents heat transfer between the high-pressure refrigerant in the discharge chamber and the low-pressure refrigerant in the peripheral suction zone.

2. The scroll compressor of claim 1, wherein the high-strength thermally insulative partition assembly minimizes or prevents heat transfer between the high-pressure refrigerant in the discharge chamber and the low-pressure refrigerant in the peripheral suction zone so that a temperature of the low-pressure refrigerant rises less than or equal to about 30% between the inlet and entering the peripheral suction zone due to the heat transfer.

3. The scroll compressor of claim 1, wherein the insulating region has a thermal conductivity (K) of less than or equal to about 90 mW/m·K at standard temperature and pressure conditions.

4. The scroll compressor of claim 1, wherein the insulating region comprises an insulating material selected from the group consisting of: polytetrafluoroethylene (PTFE), polyurethane, polyamides, nylon, rubbers, elastomers, silica, glass, gas-filled powders, gas-filled fibers, aerogels, perlite, vermiculite, rock wool, lampblack, evacuated calcium silicate, opacified powder, evacuated powder, and combinations thereof.

5. The scroll compressor of claim 1, wherein the thermal conductivity is greater than or equal to about 0.5 mW/m·K and less than or equal to about 60 mW/m·K.

6. The scroll compressor of claim 1, wherein the assembly comprises an insulating coating on a surface of the metal plate.

7. The scroll compressor of claim 6, wherein the insulating coating is absent on edge regions of the metal plate.

8. A method of operating a scroll compressor comprising:

introducing a low-pressure refrigerant into an inlet in fluid communication with a peripheral suction zone of a compression mechanism comprising a first scroll member having a discharge port and a first spiral wrap and a second scroll member having a second spiral wrap, the first and second spiral wraps being mutually intermeshed to create at least one enclosed space of progressively changing volume for compression between the peripheral suction zone and the discharge port to create a high-pressure refrigerant; and compressing the low-pressure refrigerant in the compression mechanism by a motor that causes the second scroll member to orbit with respect to the first scroll member to create a high-pressure refrigerant that exits through the discharge port of the first scroll member into a discharge chamber, wherein a high-strength thermally insulative partition assembly is disposed between the first scroll member and a discharge chamber in fluid communication with the discharge port and comprises a first metal plate, a second metal plate, and an insulating region sandwiched between the first metal plate and the second metal plate, wherein the insulating region has a thermal conductivity (K) of less than or equal to about 300 mW/m·K at standard temperature and pressure conditions, wherein the high-strength thermally insulative partition assembly has a tensile strength of greater than or equal to about 35,000 psi (about 241 MPa) and the high-strength thermally insulative partition assembly minimizes or prevents heat transfer between the high-pressure refrigerant in the discharge chamber and the low-pressure refrigerant in the peripheral suction zone.

9. The method of claim 8, wherein an energy efficiency ratio (EER) gain is greater than or equal to about 4% at ARI operating conditions for the scroll compressor comprising the high-strength thermally insulative partition assembly as compared to a comparative scroll compressor having a metal partition.

10. A scroll compressor comprising:

a first scroll member having a discharge port and a first spiral wrap;

a second scroll member having a second spiral wrap, the first and second spiral wraps being mutually intermeshed to define a peripheral suction zone in fluid communication with an inlet that receives low-pressure refrigerant;

a high-strength thermally insulative partition assembly that is disposed between the first scroll member and a discharge chamber in fluid communication with the discharge port, wherein the high-strength thermally insulative partition assembly comprises a first metal plate, a second metal plate, and an insulating region sandwiched between the first metal plate and the second metal plate, wherein the insulating region has a thermal conductivity (K) of less than or equal to about 300 mW/m·K at standard temperature and pressure conditions and the high-strength thermally insulative partition assembly has a tensile strength of greater than or equal to about 35,000 psi (about 241 MPa); and a motor for causing the second scroll member to orbit with respect to the first scroll member, whereby the first spiral wrap and the second spiral wrap create at least one enclosed space of progressively changing volume between the peripheral suction zone and the discharge port to create a high-pressure refrigerant, wherein the high-strength thermally insulative partition assembly minimizes or prevents heat transfer between the high-pressure refrigerant in the discharge chamber and the low-pressure refrigerant in the peripheral suction zone.

11. The scroll compressor of claim 10, wherein the insulating region is a low-pressure chamber or a vacuum chamber.

12. The scroll compressor of claim 10, wherein the insulating region comprises an insulating material.

13. The scroll compressor of claim 12, wherein the insulating material is selected from the group consisting of: polymers, polymeric composites, foam, opacified powder, evacuated powder, and combinations thereof.

14. The scroll compressor of claim 10, wherein the insulating region comprises an insulating material selected from the group consisting of: polytetrafluoroethylene (PTFE), polyurethane, polyamides, nylon, rubbers, elastomers, silica, glass, gas-filled powders, gas-filled fibers, aerogels, perlite, vermiculite, rock wool, lampblack, evacuated calcium silicate, opacified powder, evacuated powder, and combinations thereof.

15. A scroll compressor comprising:

a first scroll member having a discharge port and a first spiral wrap;

a second scroll member having a second spiral wrap, the first and second spiral wraps being mutually intermeshed to define a peripheral suction zone in fluid communication with an inlet that receives low-pressure refrigerant;

a high-strength thermally insulative partition assembly that is disposed between the first scroll member and a discharge chamber in fluid communication with the discharge port, wherein the high-strength thermally insulative partition assembly comprises a first metal plate, a second metal plate, and an insulating region having a thermal conductivity (K) of less than or equal to about 300 mW/m·K at standard temperature and pressure conditions and the high-strength thermally insulative partition assembly has a tensile strength of greater than or equal to about 35,000 psi (about 241 MPa), wherein the first metal plate and the second metal plate are joined to each other and a portion of a housing at a peripheral region by a fillet weld joint, a lap weld joint, a butt weld joint, an insert weld joint, or a resistance weld nugget; and a motor for causing the second scroll member to orbit with respect to the first scroll member, whereby the first spiral wrap and the second spiral wrap create at least one enclosed space of progressively changing volume between the peripheral suction zone and the discharge port to create a high-pressure refrigerant, wherein the high-strength thermally insulative partition assembly minimizes or prevents heat transfer between the high-pressure refrigerant in the discharge chamber and the low-pressure refrigerant in the peripheral suction zone.

16. A scroll compressor comprising:

a first scroll member having a discharge port and a first spiral wrap;

a second scroll member having a second spiral wrap, the first and second spiral wraps being mutually intermeshed to define a peripheral suction zone in fluid communication with an inlet that receives low-pressure refrigerant;

a high-strength thermally insulative partition assembly comprising a metal plate and an insulating region that is disposed between the first scroll member and a discharge chamber in fluid communication with the discharge port, wherein the insulating region comprises a distinct mask component secured to the metal plate via a mechanical interlock or a mold-in feature and that has a thermal conductivity (K) of less than or equal to about 300 mW/m·K at standard temperature and pressure conditions and the mask component comprises a plurality of protrusions on a first engagement surface and the metal plate comprises a plurality of undercuts on a second engagement surface, where the mechanical interlock includes the plurality of protrusions and the plurality of undercuts that are complementary to one another, wherein the plurality of protrusions secure the metal plate to the mask component when the first engagement surface and the second engagement surface are slid into contact with one another and the high-strength thermally insulative partition assembly has a tensile strength of greater than or equal to about 35,000 psi (about 241 MPa); and a motor for causing the second scroll member to orbit with respect to the first scroll member, whereby the first spiral wrap and the second spiral wrap create at least one enclosed space of progressively changing volume between the peripheral suction zone and the discharge port to create a high-pressure refrigerant, wherein the high-strength thermally insulative partition assembly minimizes or prevents heat transfer between the high-pressure refrigerant in the discharge chamber and the low-pressure refrigerant in the peripheral suction zone.

17. The scroll compressor of claim 16, wherein the high-strength thermally insulative partition assembly minimizes or prevents heat transfer between the high-pressure refrigerant in the discharge chamber and the low-pressure refrigerant in the peripheral suction zone so that a temperature of the low-pressure refrigerant rises less than or equal to about 30% between the inlet and entering the peripheral suction zone due to the heat transfer.

18. The scroll compressor of claim 16, wherein the insulating region has a thermal conductivity (K) of less than or equal to about 90 mW/m·K at standard temperature and pressure conditions.

19. The scroll compressor of claim 16, wherein the insulating region comprises an insulating material selected from the group consisting of: polytetrafluoroethylene (PTFE), polyurethane, polyamides, nylon, rubbers, elastomers, silica, glass, gas-filled powders, gas-filled fibers, aerogels, perlite, vermiculite, rock wool, lampblack, evacuated calcium silicate, opacified powder, evacuated powder, and combinations thereof.

* * * * *